US010857066B2

(12) United States Patent
Lin et al.

(10) Patent No.: US 10,857,066 B2
(45) Date of Patent: Dec. 8, 2020

(54) WATER SPRAYING DEVICE FOR ABOVE GROUND POOL

(71) Applicant: Intex Marketing Ltd., Tortola (VG)

(72) Inventors: Hua Hsiang Lin, Fujian (CN); Yaw Yuan Hsu, Fujian (CN)

(73) Assignee: Intex Marketing Ltd., Tortola (GB)

( * ) Notice: Subject to any disclaimer, the term of this patent is extended or adjusted under 35 U.S.C. 154(b) by 0 days.

(21) Appl. No.: 16/192,846

(22) Filed: Nov. 16, 2018

(65) Prior Publication Data

US 2019/0083356 A1 Mar. 21, 2019

Related U.S. Application Data

(62) Division of application No. 15/329,971, filed as application No. PCT/IB2016/000633 on May 11, 2016, now Pat. No. 10,537,492.

(30) Foreign Application Priority Data

May 12, 2015 (CN) ..... 2015 2 0302803 U
Nov. 24, 2015 (CN) ..... 2015 2 0945077 U

(51) Int. Cl.
*A61H 33/02* (2006.01)
*E04H 4/12* (2006.01)
(Continued)

(52) U.S. Cl.
CPC ..... *A61H 33/027* (2013.01); *A61H 33/0087* (2013.01); *A61H 33/6063* (2013.01);
(Continued)

(58) Field of Classification Search
CPC ..... A61H 33/027; A61H 33/0087; A61H 33/6063; A61H 33/6094; E04H 4/12; E04H 4/14
(Continued)

(56) References Cited

U.S. PATENT DOCUMENTS 3,063,077 A 11/1962 Pansini
3,677,474 A 7/1972 Lorenzen
(Continued)

FOREIGN PATENT DOCUMENTS

CA 590252 1/1960
CL 199300270 U1 3/1993
(Continued)

OTHER PUBLICATIONS

International Search Report and Written Opinion dated Sep. 12, 2016 in International Application No. PCT/IB2016/000633, 5 pages.
(Continued)

*Primary Examiner* — Tuan N Nguyen
(74) *Attorney, Agent, or Firm* — Faegre Drinker Riddle & Reath LLP

(57) ABSTRACT

An aeration nozzle for spraying water infused with air into an above-ground water cavity defined by a wall, comprising a nozzle body having at least a first internal conical portion including an upstream end and a downstream end, the downstream end being smaller than the upstream end, a water way extending through the nozzle body and the first internal conical portion, an air way extending through the nozzle body, the air way intercepting the water way within the nozzle body downstream of the first internal conical portion, and a check valve disposed along the air way that permits air to be pulled through the air way and into the water way by way of a vacuum force caused by water flowing within the water way through the first internal conical portion and prevents water from entering the air way.

25 Claims, 28 Drawing Sheets

(51) Int. Cl.
*A61H 33/00* (2006.01)
*E04H 4/14* (2006.01)

(52) U.S. Cl.
CPC ..... *A61H 33/6094* (2013.01); *E04H 4/12* (2013.01); *E04H 4/14* (2013.01); *A61H 2033/023* (2013.01)

(58) Field of Classification Search
USPC ..... 4/541.4, 541.6
See application file for complete search history.

(56) References Cited

U.S. PATENT DOCUMENTS

| | | | | |
|---|---|---|---|---|
| 4,168,705 | A | 9/1979 | Raab | |
| 4,340,039 | A | 3/1982 | Neenan | |
| 4,320,541 | A | 7/1982 | Hibbard | |
| 4,420,846 | A * | 12/1983 | Bonner | A61H 33/0087 4/541.6 |
| 4,773,104 | A | 9/1988 | Wang et al. | |
| 4,928,885 | A | 5/1990 | Nakao | |
| 4,972,531 | A * | 11/1990 | Gravatt | A61H 33/027 4/541.6 |
| 5,058,220 | A | 10/1991 | Mikiya | |
| 5,095,558 | A | 3/1992 | Howard | |
| 5,253,374 | A * | 10/1993 | Langill | E04H 4/12 4/508 |
| 5,279,003 | A | 1/1994 | Gape et al. | |
| 5,494,259 | A | 2/1996 | Peterson | |
| 5,495,627 | A | 3/1996 | Leaverton et al. | |
| 5,754,989 | A | 5/1998 | Ludlow | |
| 5,809,648 | A | 9/1998 | Kurth et al. | |
| 5,810,262 | A | 9/1998 | Ton | |
| 5,863,128 | A | 1/1999 | Mazzei | |
| 5,919,359 | A | 7/1999 | Bisseker | |
| 5,920,924 | A | 7/1999 | Pinciaro | |
| 5,978,982 | A | 11/1999 | Leeuwerik | |
| 5,983,417 | A | 11/1999 | Perdreau et al. | |
| 5,987,663 | A | 11/1999 | Ludlow et al. | |
| 6,000,073 | A | 12/1999 | Eddington | |
| 6,086,759 | A | 7/2000 | Bisseker | |
| 6,092,246 | A | 7/2000 | Ludlow | |
| 6,123,274 | A | 9/2000 | Perdreau et al. | |
| 6,141,804 | A | 11/2000 | Pinciaro | |
| 6,256,805 | B1 | 7/2001 | Ludlow et al. | |
| 6,264,122 | B1 | 7/2001 | Perdreau et al. | |
| 6,334,224 | B1 | 1/2002 | Chalberg et al. | |
| 6,357,059 | B1 | 3/2002 | Lau | |
| 6,470,508 | B2 | 10/2002 | Turner | |
| 6,491,238 | B1 | 12/2002 | Swanson et al. | |
| 6,510,277 | B1 | 1/2003 | Dongo | |
| 6,543,067 | B2 | 4/2003 | Eddinton et al. | |
| 6,745,413 | B2 | 6/2004 | Pinciaro | |
| 7,644,452 | B2 | 1/2010 | Colin | |
| 7,743,437 | B2 | 6/2010 | Reynoso | |
| 7,849,529 | B2 | 12/2010 | Bedard | |
| 7,908,684 | B2 | 3/2011 | Ludlow | |
| 7,950,077 | B2 | 5/2011 | Santamarina et al. | |
| 8,661,576 | B2 | 3/2014 | Ludlow et al. | |
| 8,869,320 | B1 | 10/2014 | Santamarina et al. | |
| 10,537,492 | B2 | 1/2020 | Lin et al. | |
| 2004/0194203 | A1 | 10/2004 | Pinciaro | |
| 2006/0260038 | A1 | 11/2006 | Lau | |
| 2007/0079433 | A1 | 4/2007 | Juneau et al. | |
| 2007/0192952 | A1 | 8/2007 | Lau | |
| 2007/0226892 | A1 | 10/2007 | Strickland et al. | |
| 2008/0134425 | A1 | 6/2008 | Tatum | |
| 2009/0242047 | A1 | 10/2009 | Hilton et al. | |
| 2012/0005819 | A1 | 1/2012 | Yuhas et al. | |
| 2012/0124732 | A1 | 5/2012 | Lau | |
| 2014/0131472 | A1 | 5/2014 | Eddington | |
| 2015/0020306 | A1 | 1/2015 | Lin et al. | |

FOREIGN PATENT DOCUMENTS

| | | |
|---|---|---|
| CN | 1030731327 | 5/2013 |
| CN | 204139662 | 2/2014 |
| CN | 203640337 | 6/2014 |
| CN | 205000681 | 1/2016 |
| CN | 205135021 | 4/2016 |
| DE | 4323634 | 1/1995 |
| EP | 0861653 A1 | 9/1998 |
| EP | 1116482 | 7/2001 |
| RU | 2511978 | 4/2014 |
| WO | 91/01675 A1 | 2/1991 |
| WO | 2016/181209 A1 | 11/2016 |

OTHER PUBLICATIONS

Office Action dated Jan. 29, 2018 in Canadian Application No. 2,955,104, 6 pages.

Supplementary European Search Report dated Apr. 16, 2018 in European Application No. 16792255.8, 9 pages.

Intex Ownership Manual, "Krystal Clear™ Model 638G Filter Pump", Sep. 14, 2007, 15 pages.

W. Beitz and K.-H Küntner (Herausgeber), "Dubbel Taschenbuch für den Maschinenbau, 17. Auflage", 1990, Springer-Verlag, Berlin ISBN 3-540-52381-2, 4 pgs.

Communication pursuant to Article 94(3) EPC issued by the EPO dated Feb. 28, 2019 in European Application 16 792 255.8, 6 pgs.

International Preliminary Report on Patentability received for PCT Patent Application No. PCT/IB2016/000633, dated Nov. 23, 2017, 7 pages.

* cited by examiner

WATER SPRAYING DEVICE FOR ABOVE GROUND POOL

CROSS REFERENCE TO RELATED APPLICATIONS

This application is a divisional of U.S. patent application Ser. No. 15/329,971, filed Jan. 27, 2017, which is a national stage application based on International Patent Application No. PCT/IB2016/000633, filed May 11, 2016, which claims priority to the following applications, the disclosures of which are hereby expressly incorporated by reference herein in their entirety:

| Application No. | Filing Date |
|---|---|
| CN 201520302803.2 | May 12, 2015 |
| CN 201520945077.6 | Nov. 24, 2015 |

FIELD OF THE DISCLOSURE

The present invention relates to a water spraying device comprising at least one aeration nozzle, more specifically to a water spraying device comprising at least one aeration nozzle configured to provide massaging water infused with air to a water cavity without the use of an air pump.

BACKGROUND OF THE DISCLOSURE

Permanent swimming pools, hot tubs and/or bathtubs are known to spray water into a water cavity to serve as massaging water. Furthermore, it is known to incorporate air while spraying the water to enhance the overall massaging effect. In general, air is incorporated into spraying water by way of an air pump. However, it would be beneficial to have a movable water cavity with a water spraying device which provides massaging water, wherein air can be incorporated into the massaging water without the use of an air pump.

SUMMARY

The present disclosure provides a water spraying device including at least one aeration nozzle for providing massaging water infused with air to a water cavity.

According to an embodiment of the present disclosure, an aeration nozzle for spraying water infused with air into an above-ground water cavity defined by a wall comprises a nozzle body having at least a first internal conical portion, the first internal conical portion including an upstream and a downstream end, the downstream end being smaller than the upstream end, a water way extending through the nozzle body and the first internal conical portion, an air way extending through the nozzle body, the air way intercepting the water way within the nozzle body downstream of the first internal conical portion, and a check valve disposed along the air way that permits air to be pulled through the air way and into the water way by way of a vacuum force caused by water flowing within the water way through the first internal conical portion and prevents water from entering the air way.

In one aspect of the aeration nozzle, the nozzle further includes a spraying portion coupled at a downstream end of the nozzle, at least a portion of the nozzle body is located externally of the wall and the spraying portion is located internally of the wall and inside the water cavity.

In another aspect of the aeration nozzle, the air way includes an air inlet positioned vertically higher than at least a portion of the nozzle body.

In a further aspect of the aeration nozzle, the air inlet is positioned above a filled water level within the water cavity.

In another aspect of the aeration nozzle, the air inlet is positioned below a filled water level within the water cavity.

In another aspect of the aeration nozzle, the air way includes a narrow suction hole downstream of the air inlet and upstream of the water way.

In a further aspect of the aeration nozzle, the nozzle body further includes a second internal conical portion, a smaller, upstream end of the second internal conical portion being congruent with the downstream end of the first internal conical portion.

In another aspect of the aeration nozzle, the intersection between the air way and the water way is substantially perpendicular.

In another aspect of the aeration nozzle, the wall is supported by an upper rack, and the water way and the air way both extend through the wall at a location vertically beneath the upper rack.

In another embodiment of the present disclosure, an above-ground pool comprises a wall defining a water cavity and supported by an upper rack, and a water spraying device coupled to the wall. The water spraying device generally includes at least one aeration nozzle including a nozzle body having at least a first internal conical portion including an upstream end and a downstream end, the downstream end being smaller than the upstream end, a water way extending through the first internal conical portion of the nozzle body, and an air way extending through the nozzle body and intercepting the water way within the nozzle body downstream of the first internal conical portion, the water way and the air way both extending through the wall at a location vertically beneath the upper rack.

In one aspect of the above-ground pool, the aeration nozzle further includes a check valve disposed along the air way to permit air to be pulled through the air way and into the water way by way of a vacuum force caused by water flowing within the water way and to prevent water from entering the air way.

In another aspect of the above-ground pool, the air way includes a narrow suction hole along a downstream end of the air way.

In a further aspect of the above-ground pool, each aeration nozzle further includes a spraying portion coupled at a downstream end of the aeration nozzle, the spraying portion being positioned within the water cavity.

In another aspect of the above-ground pool, the air way includes an air inlet positioned within the water cavity and above a filled level of water within the water cavity.

In another aspect of the above-ground pool, the air way includes an air inlet positioned outside of the water cavity and at least one of above and below a filled level of water within the water cavity.

In a further aspect of the above-ground pool, the air way includes an air inlet and a narrow suction hole, the narrow suction hole being positioned vertically below the air inlet.

In another embodiment of the present disclosure, a water spraying device comprises at least one aeration nozzle. The at least one aeration nozzle includes a nozzle body having at least a first internal conical portion including an upstream end and a downstream end, the downstream end being smaller than the upstream end, a water way extending through the nozzle body, and an air way extending through the nozzle body and intersecting the water way downstream of the first internal conical portion, air being present within the air way by a vacuum force caused by water flowing within the waterway, the air way including an air inlet and a narrow suction hole such that the air inlet is in direct communication with ambient air and air is drawn into the air way without an air pump by a vacuum force cause by water flowing within the water way.

In one aspect of the water spraying device, the air inlet is positioned outside of a water cavity defined by a wall and below a filled level of water within the water cavity.

In a further aspect of the water spraying device, the aeration nozzle further includes an air inlet valve positioned along the air way, the air inlet valve being downstream of the air inlet and upstream of the narrow suction hole.

In another aspect of the water spraying device, the air inlet is positioned above a filled level of water within a water cavity defined by a wall and at least one of internal or external of the water cavity.

In a further aspect of the water spraying device, the water spraying device further comprises a housing enclosing at least a portion of each of the at least one aeration nozzles.

In another aspect of the water spraying device, the water spraying device includes three aeration nozzles.

In another aspect of the water spraying device, the at least one aeration nozzle includes a check valve disposed along the air way upstream of the narrow suction hole such that air may be drawn into the air way and the water way and water may be precluded from entering the air way.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

DETAILED DESCRIPTION

Figure 1:
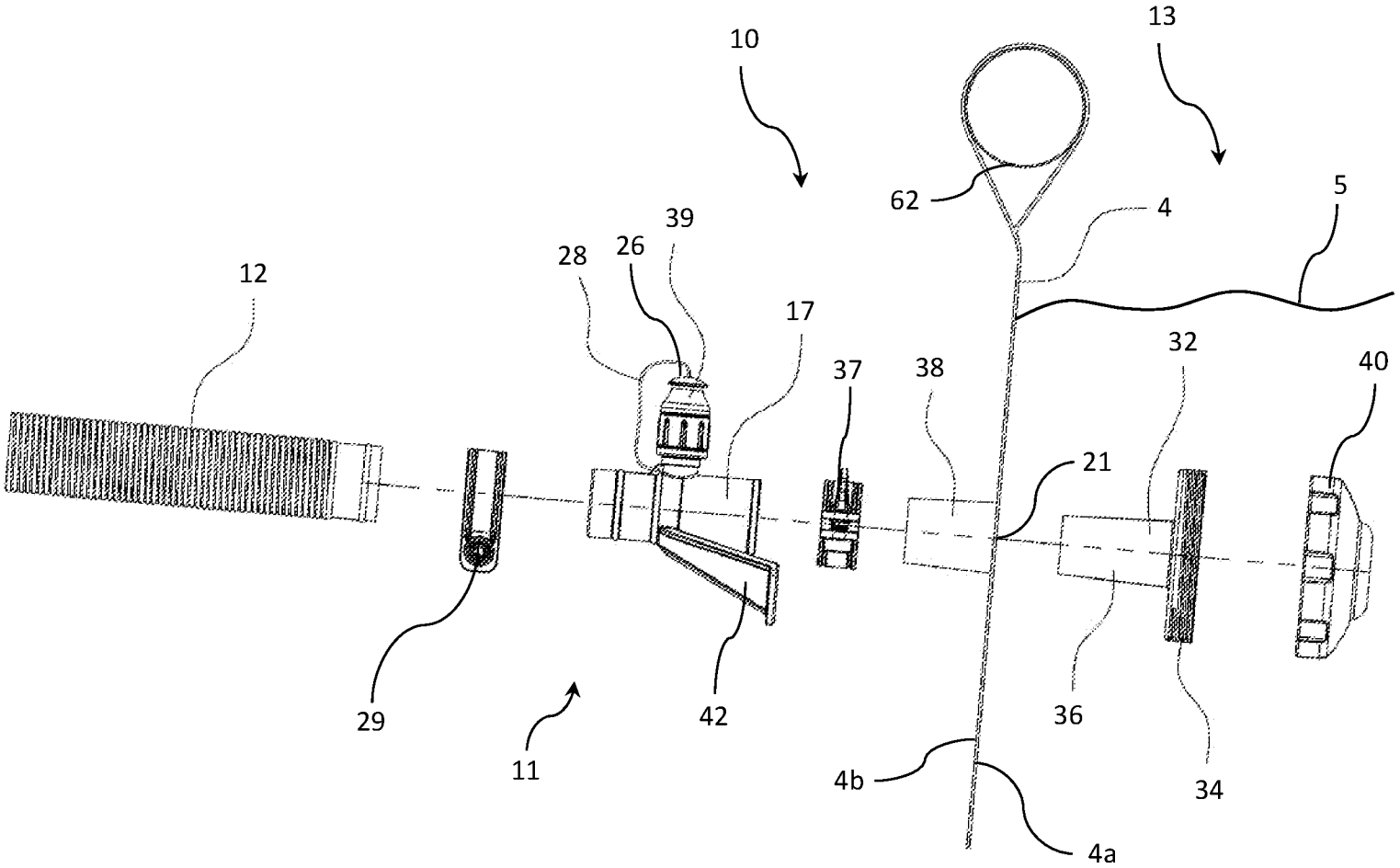
FIG. 1 is an exploded side view of an embodiment of a water spraying device of the present disclosure.

Referring to FIGS. 1-6, a water spraying device 10 of the present disclosure comprises at least one aeration nozzle 11 coupled to a water pipe 12 for providing massaging water infused with air to a water cavity 13 of an above-ground pool. The pool may be a heated spa. In certain embodiments, the pool may be movable as opposed to being permanently installed. Also, the pool may be at least partially inflatable. The illustrative water cavity 13 is defined by a wall or liner 4 and contains water having an upper surface level 5 when filled. Support structures are provided to support the pool above the ground. The illustrative support structure includes an upper pipe rack 62 that extends horizontally and annularly around the water cavity 13 with the wall 4 wrapped around and extending downwardly from the upper pipe rack 62. The support structures may also include vertical support structures (not shown) extending downwardly from the upper pipe rack 62 to the ground.

Figure 2:
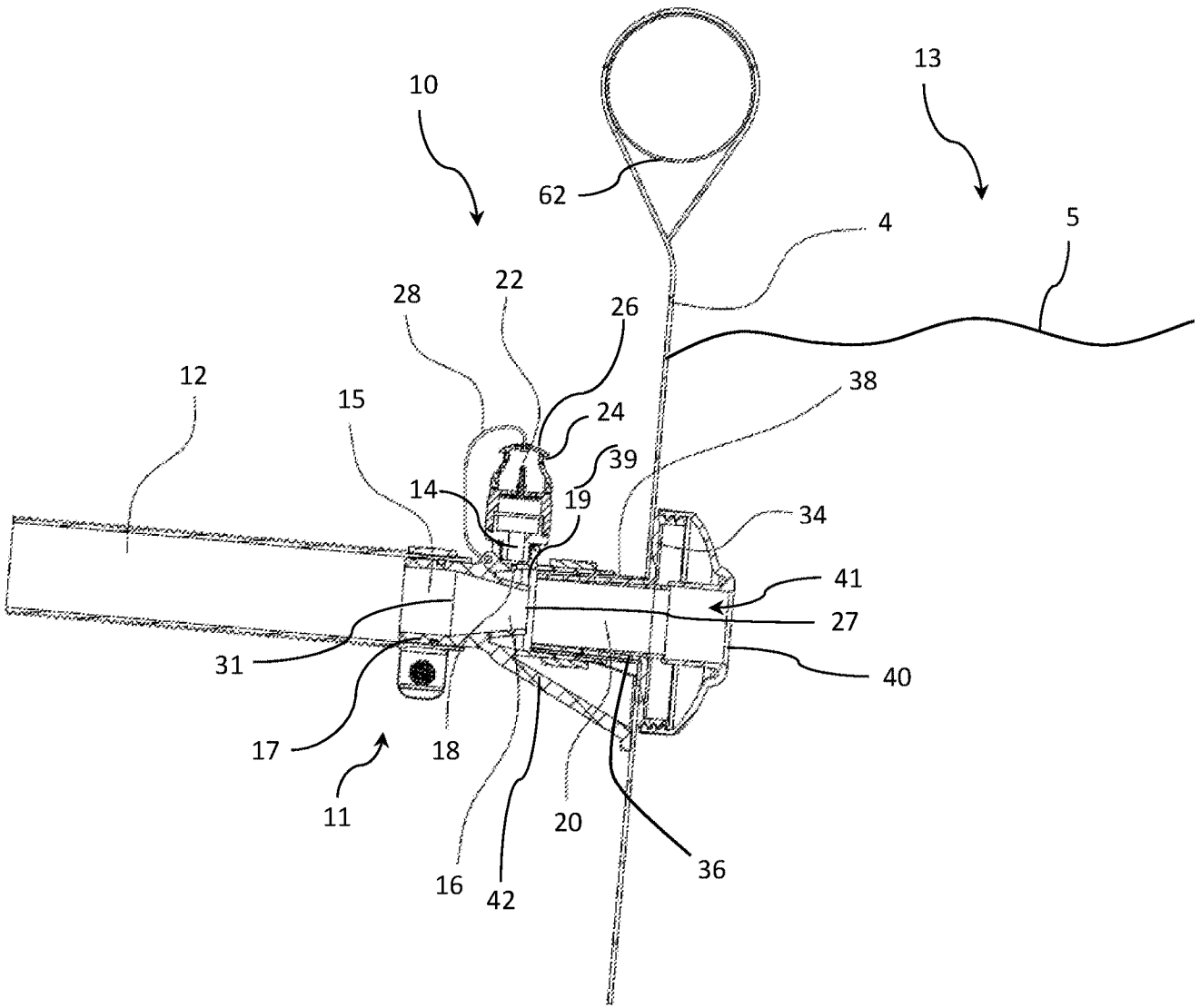
FIG. 2 is cross-sectional view of the water spraying device of FIG. 1 coupled to a wall of a water cavity.
Figure 3:
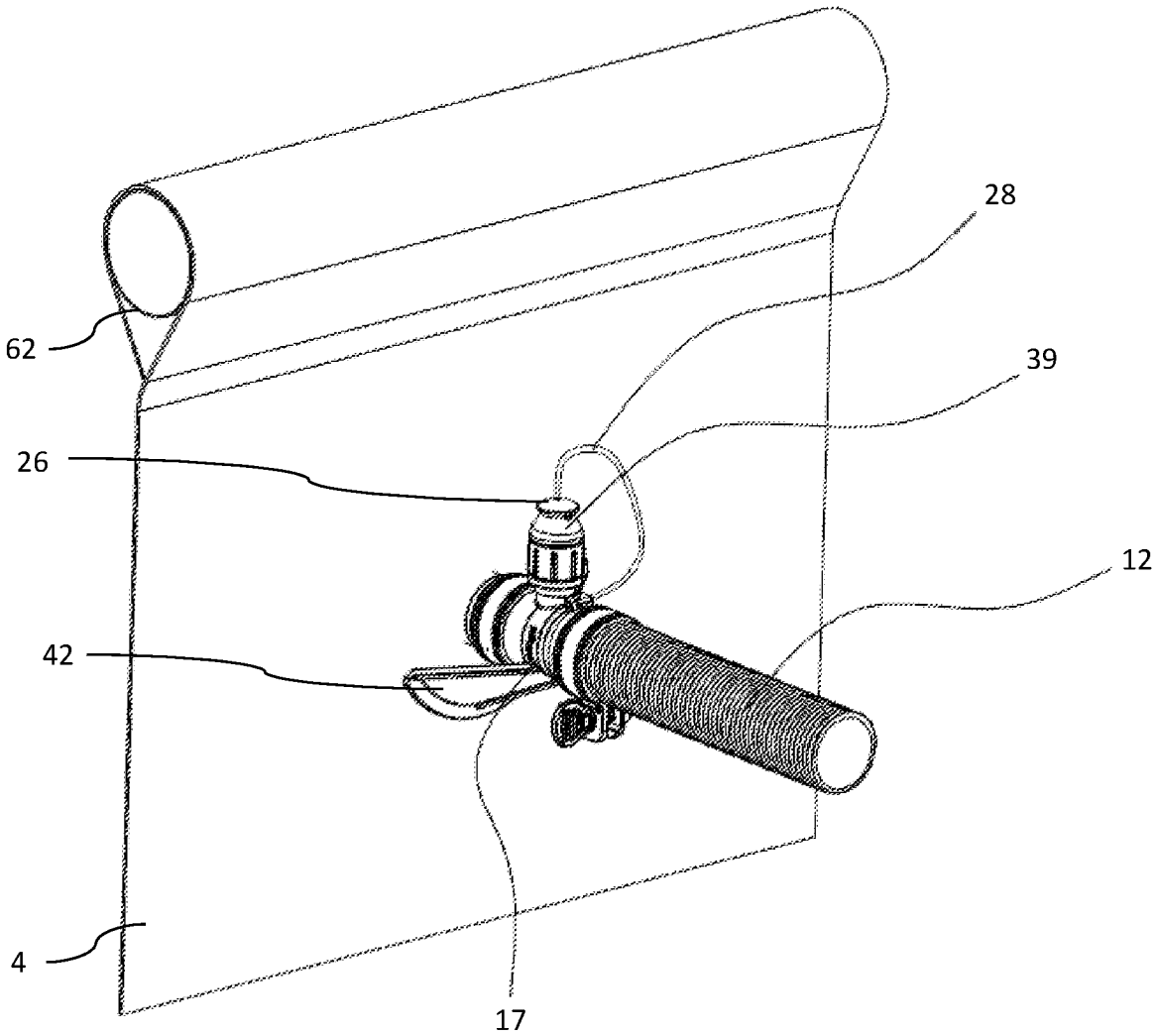
FIG. 3 is a perspective view of the water spraying device of FIG. 1 from an outer surface of the wall of the water cavity.
Figure 4:
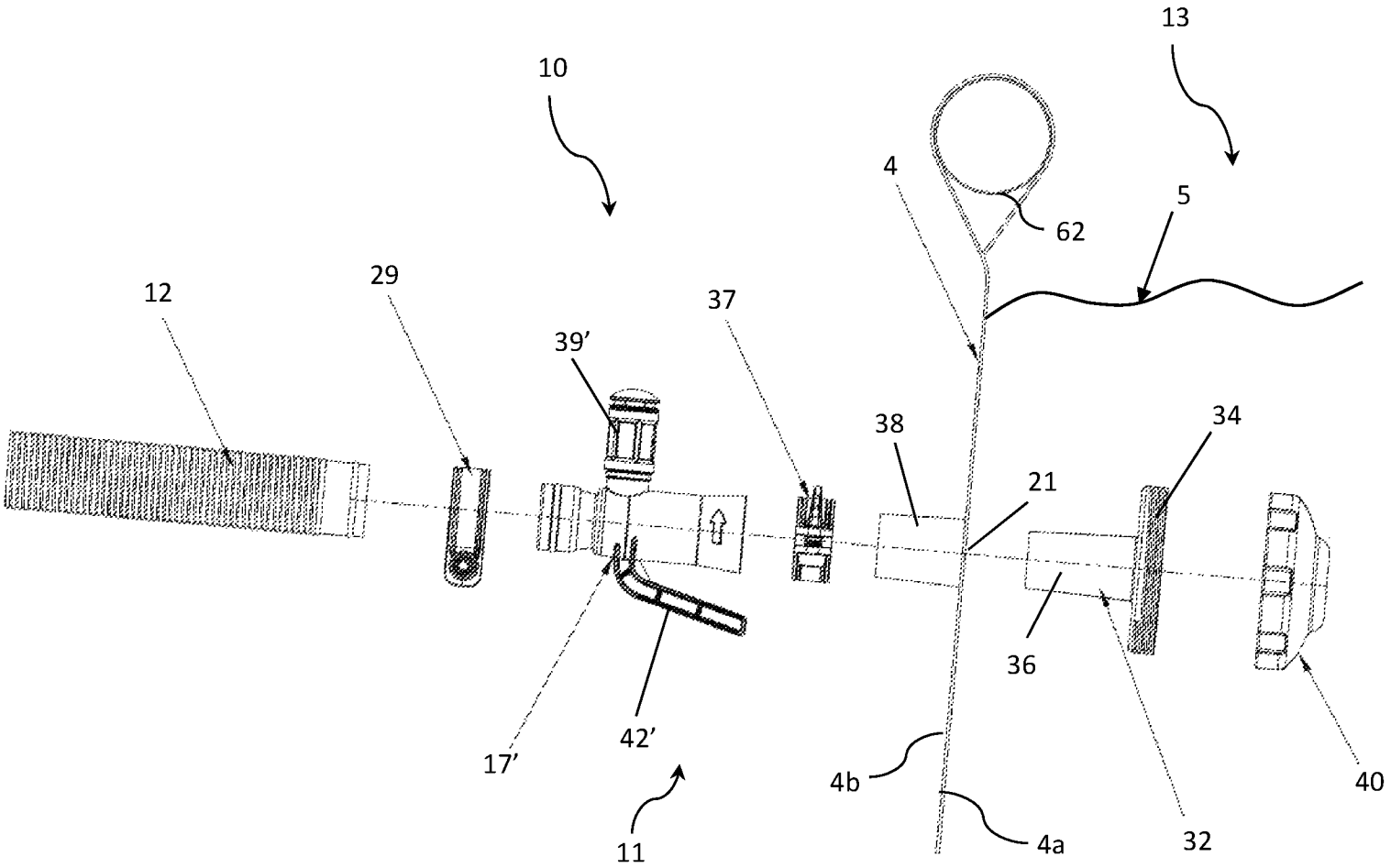
FIG. 4 is an exploded side view of another embodiment of a water spraying device of the present disclosure.
Figure 5:
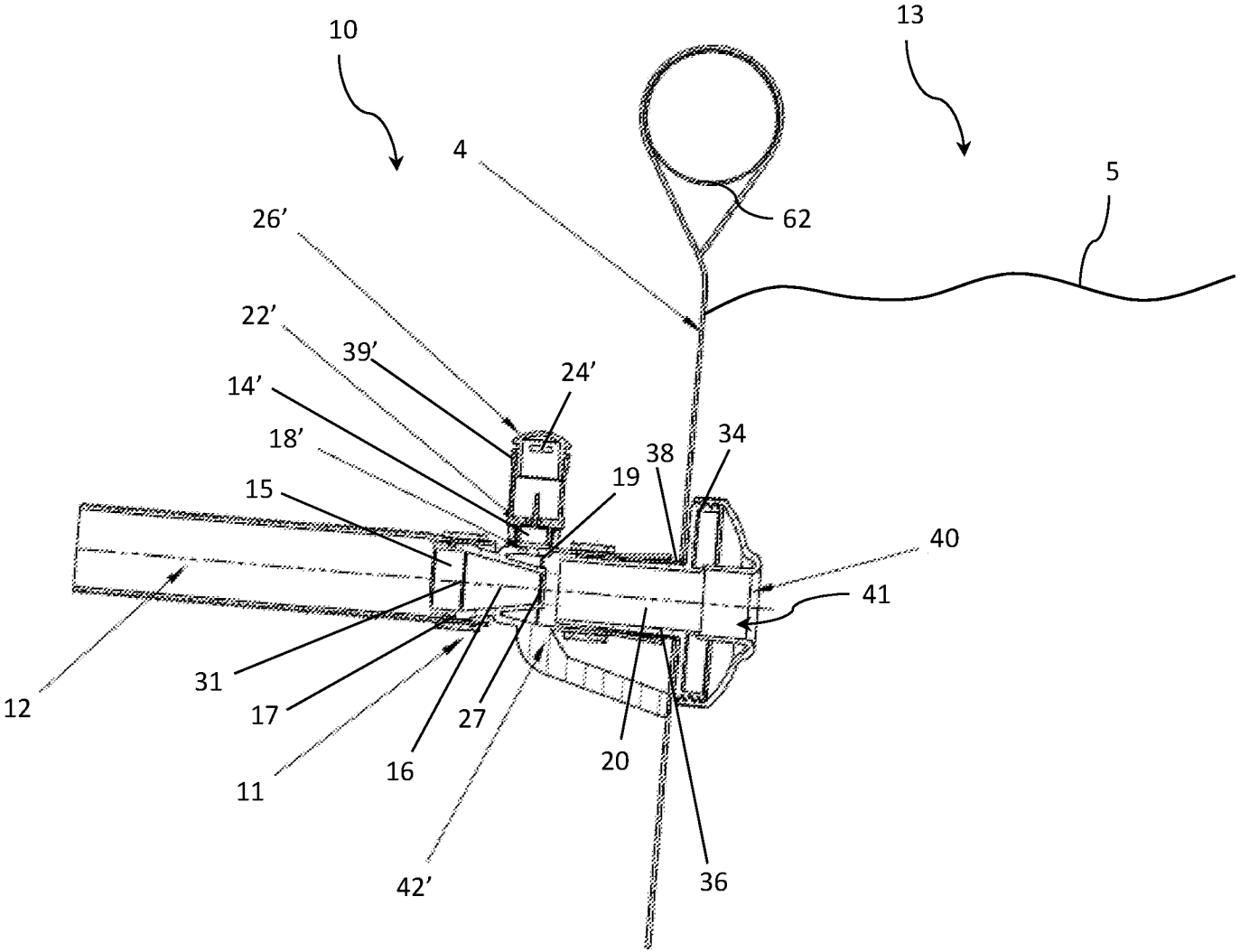
FIG. 5 is a cross-sectional view of the water spraying device of FIG. 4 coupled to a wall of a water cavity.
Figure 6B:
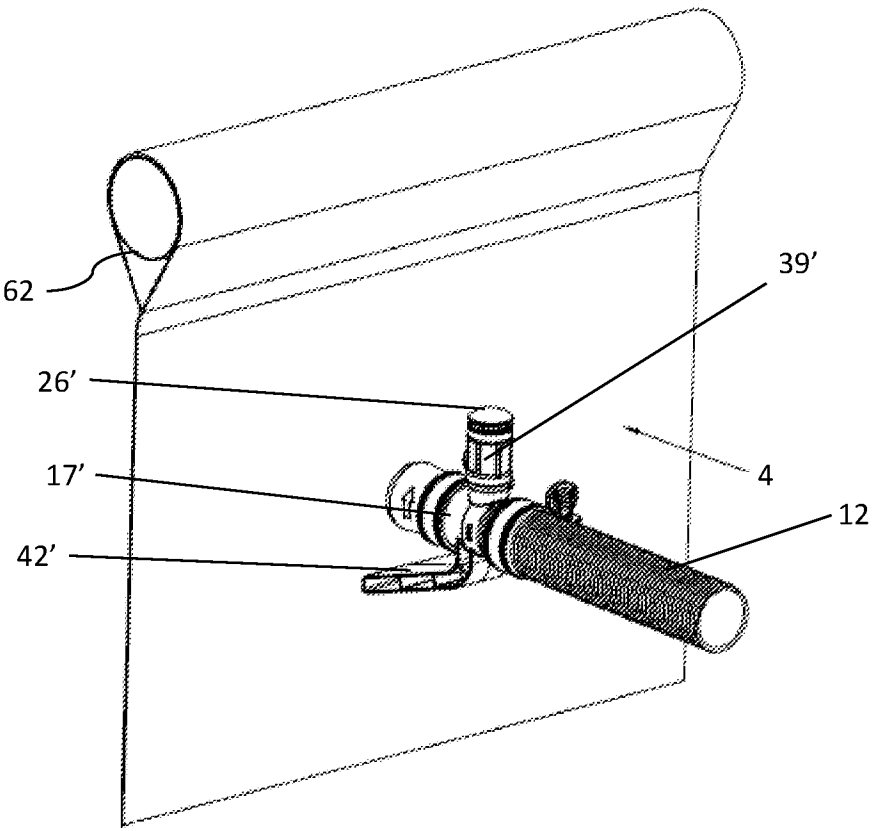
FIG. 6B is a perspective view of the water spraying device of FIG. 4 from an outer surface of the wall of the water cavity.
Figure 6A:
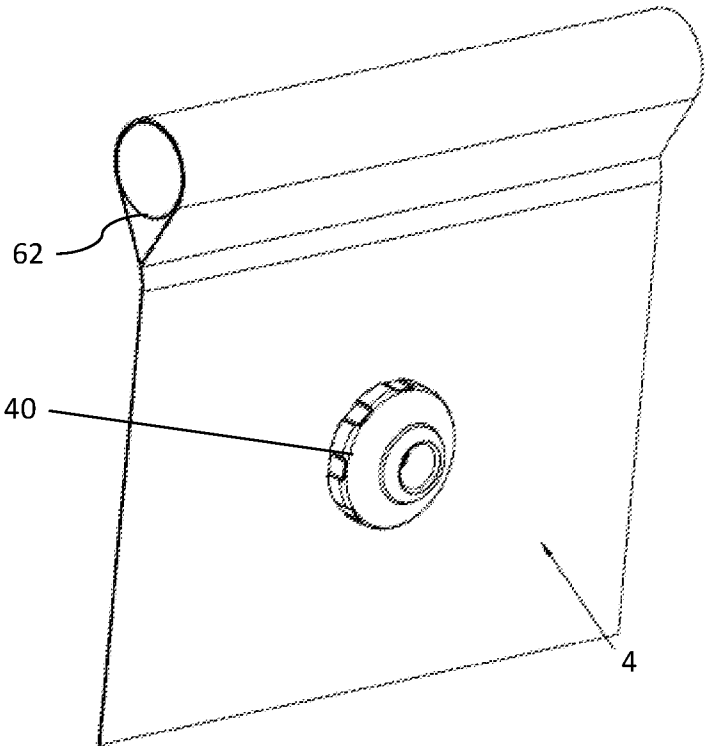
FIG. 6A is a perspective view of the water spraying device of FIG. 4 from an interior surface of the wall of the water cavity.

The water spraying device 10 shown in FIGS. 1-3 is similar to the water spraying device 10 shown in FIGS. 4-6, with like reference numerals indicating like elements. For brevity, the following description focuses on water spraying device 10 of FIGS. 1-3. However, unless otherwise noted, the following description is also applicable to water spraying device 10 of FIGS. 4-6.

Aeration nozzle 11 of water spraying device 10 generally includes a nozzle body 17 wherein at least a portion of an air way 14, at least a portion of a water way 15, and a conical hole 16 are all formed by an internal surface of nozzle body 17. In various embodiments, nozzle body 17 may have a variety of inlet and/or outlet diameters. For instance, in an illustrative embodiment, the outlet diameter of nozzle body 17 may be flared relative to conical hole 16, such that water way 15 narrows at conical hole 16 of nozzle body 17 and then widens at the outlet of nozzle body 17. Furthermore, in various embodiments, air way 14 may include at least one suction hole 18 and/or at least one air outlet 19. The cross-section of the at least one air outlet 19 and/or the at least one suction hole 18 may be in the shape of a circle, an ellipse, an oval, a rectangle, a square or any other shape with an area. The suction hole 18 may be narrower than the rest of air way 14 to pressurize the air before it reaches the air outlet 19.

Furthermore, conical hole 16 is generally configured to speed up the flow of water passing through nozzle 11. In general, as water passes through conical hole 16 of water way 15, a vacuum force is created causing air to be sucked into air way 14 through at least one radial air inlet 24 of a check valve 22 such that air may pass through suction hole 18 bend along an outer surface of conical hole 16 to become substantially parallel with water way 15, and leave air outlet 19 to be infused into water flowing through water way 15 in a water-air mixing portion 20 of nozzle 11. In various embodiments, water-air mixing portion 20 of nozzle 11 may be adjacent to conical hole 16 such that the air may mix with the water as it flows quickly through and/or out of conical hole 16. In an exemplary embodiment, air outlet 19 is arranged adjacent to a downstream, small end opening 27 of conical hole 16.

Conical hole 16 further includes an upstream, large end opening 31 opposite small end opening 27. Air outlet 19 may be located at or adjacent to the small end opening 27 such that air outlet 19 generally corresponds with the narrowest portion of water way 15. In various embodiments, the ratio of the diameter of small end opening 27 to the diameter of large end opening 31 is approximately 0.3 to 0.75. In an exemplary embodiment, the ratio between the diameters of small end opening 27 and large end opening 31 is approximately 0.4 to 0.6. Additionally, in various embodiments, the cone angle of conical hole 16 may be approximately 15 to 45 degrees. In an exemplary embodiment, the cone angle of conical hole 16 is 21 degrees. Furthermore, the ratio of the diameter of air outlet 19 or suction hole 18 to the diameter of the small end opening 27 is approximately 0.1 to 0.7. In an exemplary embodiment, the ratio between the diameter of air outlet 19 and the diameter of small end opening 27 is approximately 0.3 to 0.7, or even more specifically approximately 0.5. In general, the Reynolds number of the aeration nozzle 11 is approximately 16000 to 80000, and the water pressure of water pipe 12 is approximately 1 to 14.5 PSI, while the flow rate of water pipe 12 is approximately 300 to 2650 GPH. The formula for calculating the Reynolds number of the aeration nozzle 11 is:

$$ReD=4qv/(\pi Dv).$$

Still referring to FIGS. 1-6, water spraying device 10 may further include a base 32 coupled to an inner surface 4*a* of a wall 4 of water cavity 13 for coupling a downstream end of aeration nozzle 11 to wall 4 of water cavity 13. Base 32 may generally include a head portion 34 and a connector 36. Water pipe 12 and connector 36 are respectively coupled to the upstream and downstream ends of aeration nozzle 11 using couplers 29 and 37 respectively. When base 32 is coupled to nozzle 11, head portion 34 is adjacent to the inner surface 4*a* of wall 4 of water cavity 13, while connector 36 extends through wall 4 from the inner surface 4*a* to an outer surface 4*b* through a through hole 21 of wall 4. As shown in FIGS. 2 and 5, aeration nozzle 11 is located beneath the upper pipe rack 62. In particular, the portion of aeration nozzle 11 that extends through hole 21 in wall 4 (e.g., water-air mixing portion 20 of aeration nozzle 11) is located beneath the upper pipe rack 62. Furthermore, wall 4 of water cavity 13 may be disposed with a sock or hem 38 covering an external surface of the connector 36 when coupled to nozzle 11.

Figure 7:
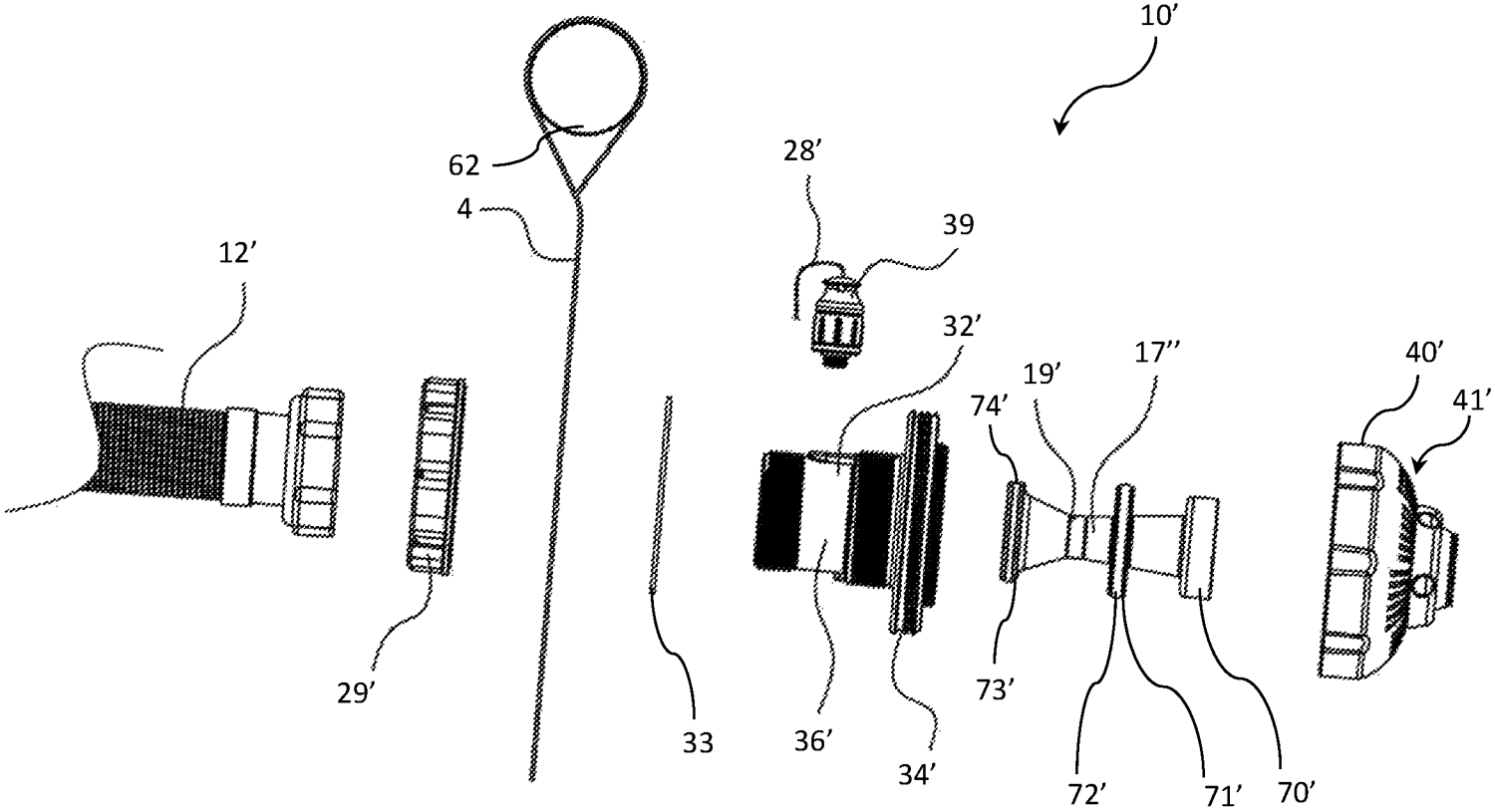
FIG. 7 is an exploded side view of another embodiment of a water spraying device of the present disclosure.
Figure 11:
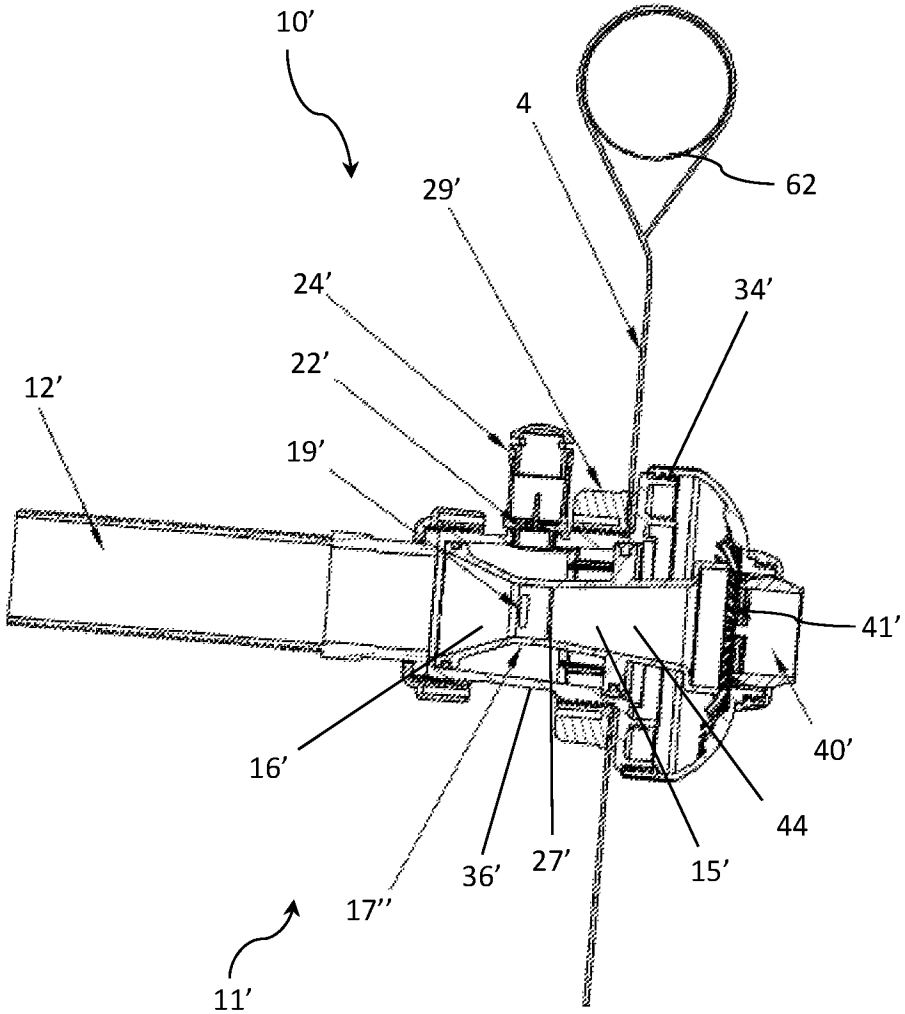
FIG. 11 is a cross-sectional view of the water spraying device of FIG. 10 coupled to a wall of a water cavity.
Figure 12B:
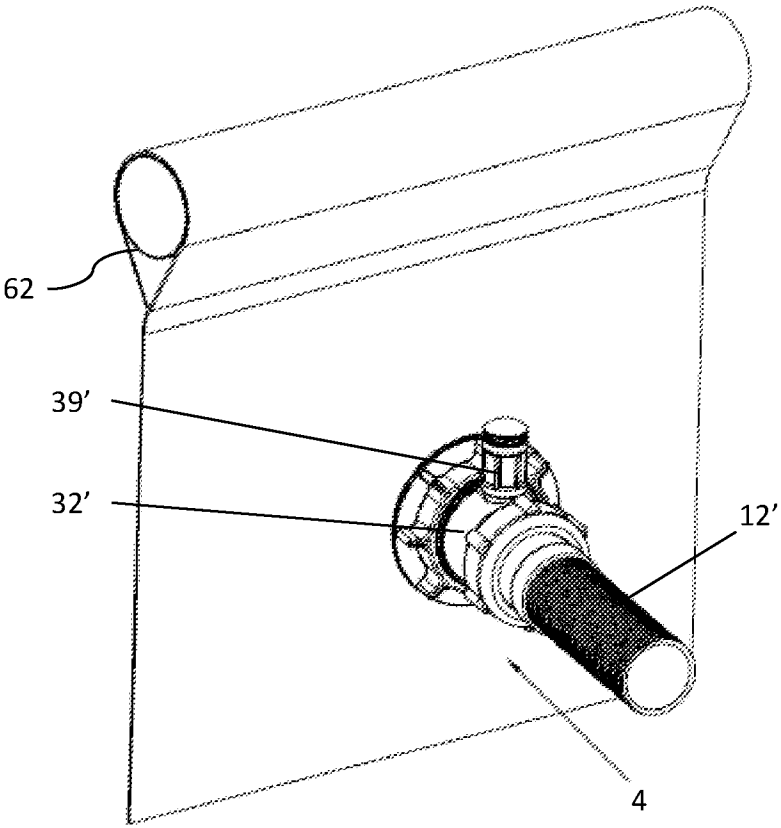
FIG. 12B is a perspective view of the water spraying device of FIG. 10 from an outer surface of the wall of the water cavity.
Figure 12A:
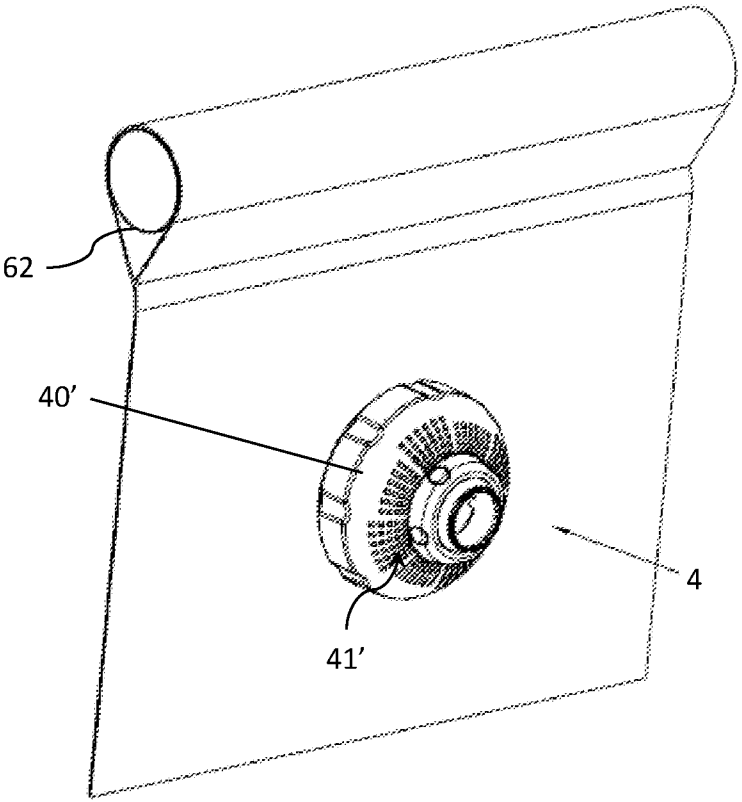
FIG. 12A is a perspective view of the water spraying device of FIG. 10 from an interior surface of the wall of the water cavity.

With continued reference to FIGS. 1-6, aeration nozzle 11 may further include a check valve 22 adjacent to air inlet(s) 24 of air way 14 to prevent water flowing up into air way 14 and leaking out of aeration nozzle 11. In various embodiments, check valve 22 may include a housing 39 and a cover 26 to keep debris from falling into and clogging air way 14. In various embodiments, cover 26 may take on a variety of different sizes. One or more radial air inlets 24 may be positioned within housing 39 beneath cover 26. Additionally, in various embodiments, air way 14 may be longer and slender (FIG. 2). Alternatively, air way 14' may be shorter and wider (FIG. 5). Furthermore, air inlet(s) 24 may also be longer and slender or shorter and wider, and may also take on a variety of different shapes, such as a circle, an oval, an ellipsis, a rectangle, a square, etc. In an illustrative embodiment, a string 28 may be coupled to cover 26 to avoid misplacement of cover 26 when servicing check valve 22 or clearing air way 14. In various embodiments, the other end of string 28 may be coupled to nozzle body 17, base 32 or any other part of aeration nozzle 11. Furthermore, check valve 22 and/or housing 39 may be coupled to nozzle body 17 or base 32 (FIGS. 7 and 11).

Still referring to FIGS. 1-6, water pipe 12 may generally be coupled between a filtering pump (not shown) and aeration nozzle 11 of water spraying device 10. In various embodiments, water in water cavity 13 may be pumped out and filtered by the filtering pump, and then pumped back into the water cavity 13 through water pipe 12 and aeration nozzle 11. Water pipe 12 is generally coupled to an upstream end of nozzle body 17 or base 32 of aeration nozzle 11 by way of a coupler 29 such as a locking ring, a nut, a bolt, a screw, or similar coupling devices.

In various embodiments and referring to FIGS. 1-6, water spraying device 10 may also include a spraying portion 40 coupled to a downstream end of base 32. In various embodiments, water from water way 15 is infused with air from air way 14 in water-air mixing portion 20 to produce massaging water, and then the massaging water may be pushed through spraying portion 40 to form and deliver a single stream of massaging water to water cavity 13 through a single outlet hole 41. It is also within the scope of the present disclosure for spraying portion 40 to include multiple outlet holes and deliver multiple streams of massaging water to water cavity 13. Furthermore, water spraying device 10 may further include a support arm 42 for supporting aeration nozzle 11. In various embodiments, support arm 42 may be coupled to nozzle body 17. A free end of support arm 42 may rest against wall 4 to hold or support aeration nozzle 11 and/or water spraying device 10 in place. In various embodiments, support arm 42 may take on a variety of different shapes. For instance, support arm 42 may be generally U-shaped against wall 4 (FIG. 3). Alternatively, support arm 42' may be generally rectangular-shaped against wall 4' and hollow in construction such that openings are exposed along the edges of both sides of arm 42' (FIG. 6B).

Referring now to FIGS. 7-12, water spraying device 10' is disclosed which may have various features in common with the above-described water spraying device 10, except as described below. Water spraying device 10' may include water way 15' of aeration nozzle 11', which may further include a flared outlet hole 44 downstream of conical hole 16'. In general, an upstream, small end opening of outlet hole 44 is congruent with the downstream, small end opening 27' of conical hole 16'. In addition, in one embodiment, air outlet 19' and the suction hole may comprise the same hole. In various embodiments, air outlet 19' may be disposed at the junction of conical hole 16' and outlet hole 44 such that air enters water way 15' at its narrowest location and in a direction perpendicular to the flow of water through water way 15'. In an exemplary embodiment, the cone angle of conical hole 16' is larger than the cone angle of outlet hole 44. For example, in the illustrated embodiment of FIG. 8, the cone angle of conical hole 16' is 41 degrees and the cone angle of outlet hole 44 is 11 degrees.

Figure 8:
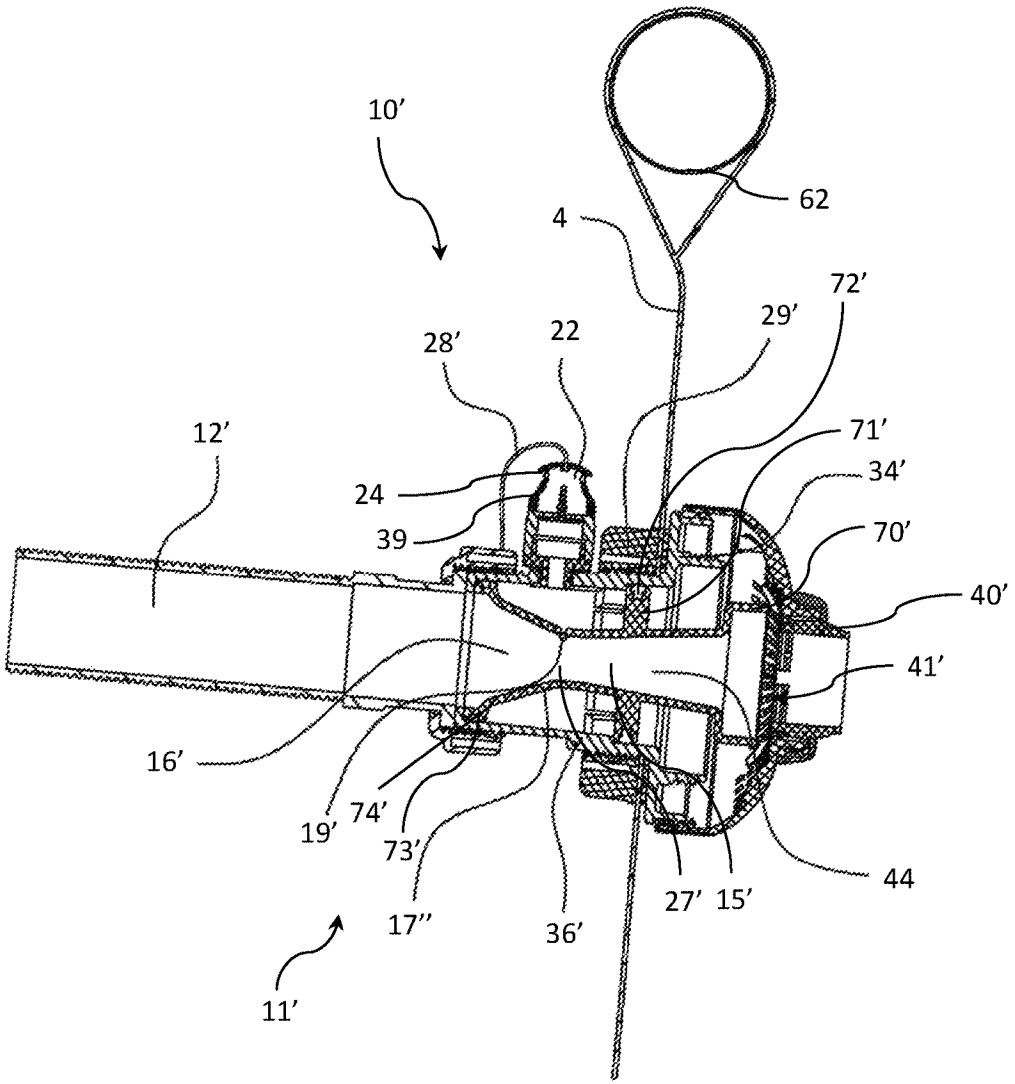
FIG. 8 is a cross-sectional view of the water spraying device of FIG. 7 coupled to a wall of a water cavity.
Figure 9:
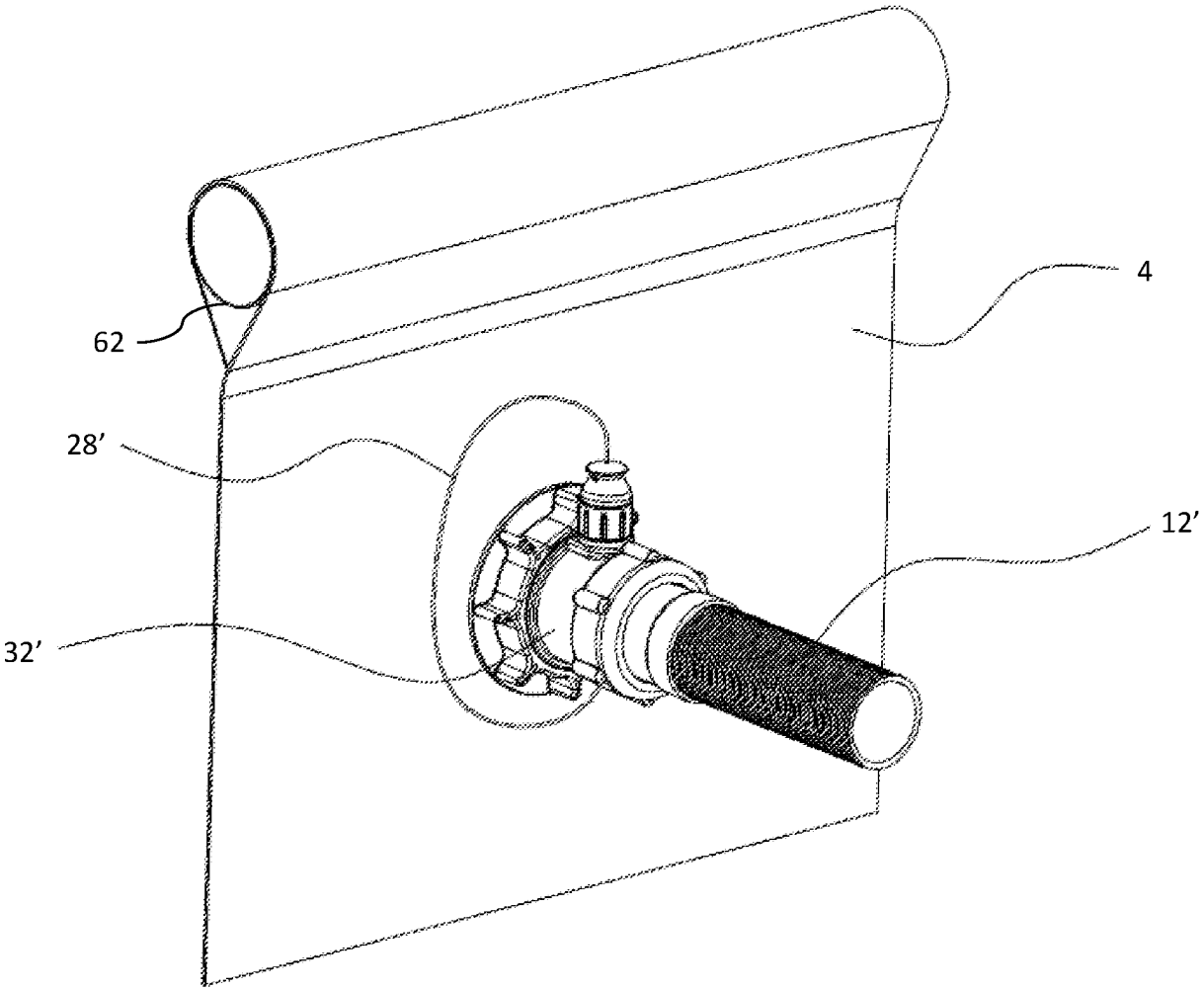
FIG. 9 is a perspective view of the water spraying device of FIG. 7 from an outer surface of the wall of the water cavity.
Figure 10:
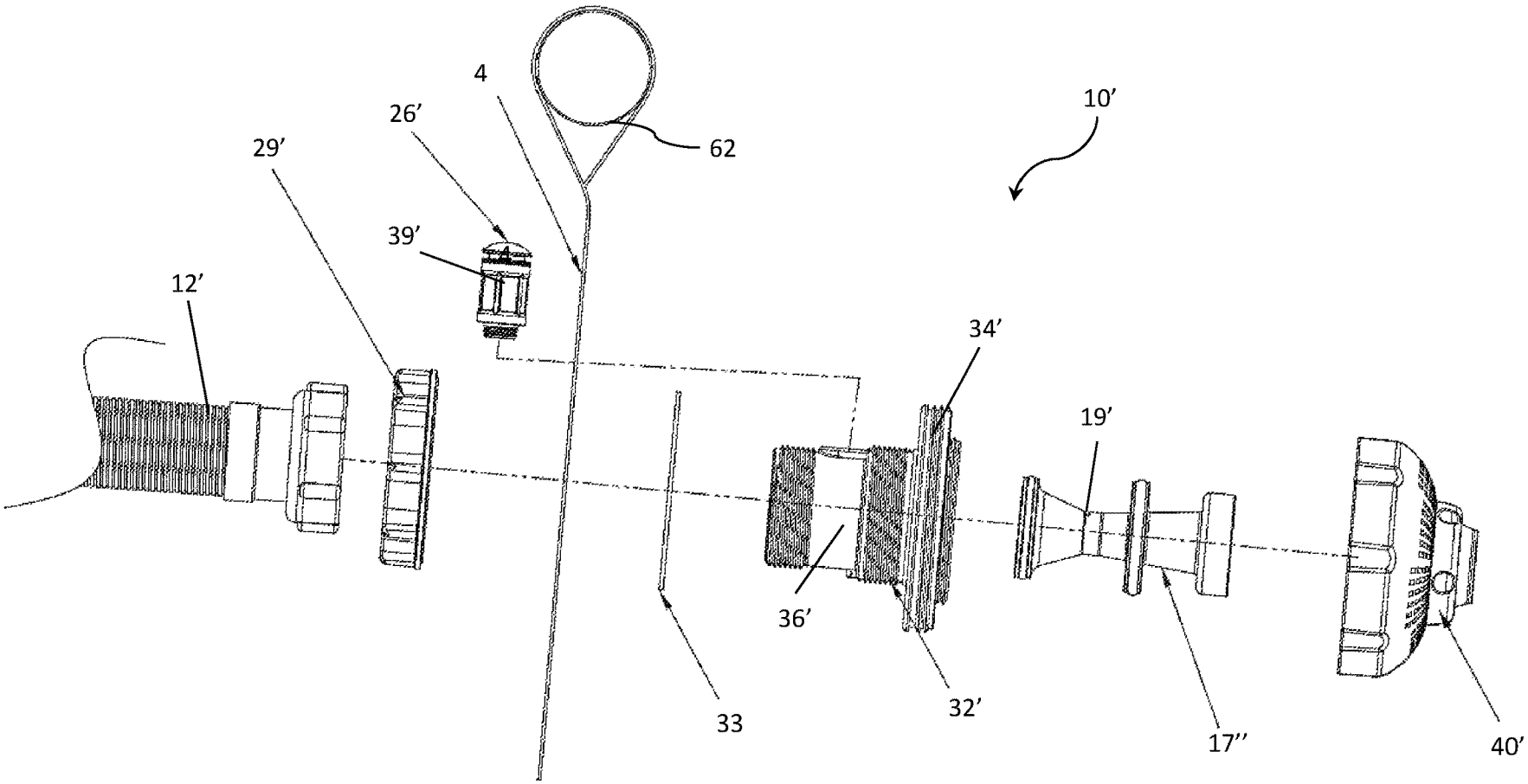
FIG. 10 is an exploded side view of another embodiment of a water spraying device of the present disclosure.

Furthermore, in general, nozzle body 17" is assembled within base 32' with the external surface of the connector 36' being threaded with a coupler 29'. As shown in FIGS. 7 and 8, the outer profile of nozzle body 17" includes a head 70', a first extension 73', and a second extension 71'. Head 70' is coupled to a downstream end of the flared outlet hole 44. Head 70' has a diameter that is greater than a diameter of the downstream end of the flared outlet hole 44. As shown specifically in FIG. 8, nozzle body 17" is disposed within base 32' with the upstream end of conical hole 16' positioned adjacent the upstream end of base 32' and head 70' extending beyond the downstream end of base 32'. First extension 73' extends radially outward from around the upstream end of conical hole 16' and includes a seal 74'. Second extension 71' extends radially outward from around the flared outlet hole 44 and includes second seal 72'. Both seals 72' and 74' abut base 32' to form a water-tight seal. In an exemplary embodiment, coupler 29' is a nut. Coupler 29' generally may be configured to thread onto connector 36', while spraying portion 40' may be configured to couple to head portion 34'. When completely coupled, as shown in FIG. 8, wall 4 is clamped between coupler 29' and head portion 34', while water pipe 12' is threaded on to an upstream end of base 32'. Additionally, in various embodiments, a washer 33 may be positioned between wall 4 and head portion 34' to help seal the connection. It is also within the scope of the present disclosure to have washers 33 on both sides of wall 4. The illustrative spraying portion 40' includes a plurality of outlet holes 41 to deliver multiple streams of massaging water.

Figure 13:
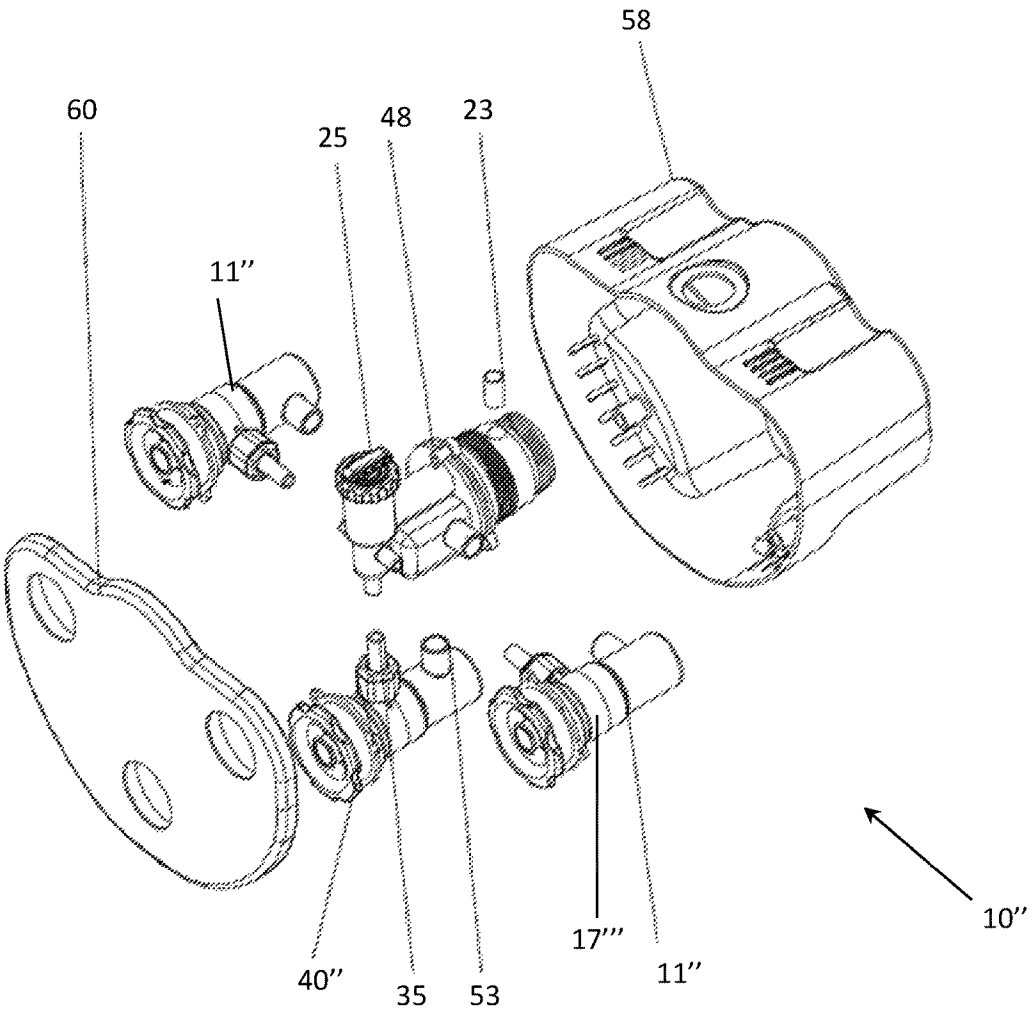
FIG. 13 is an exploded perspective view of another embodiment of a water spraying device of the present disclosure.
Figure 14:
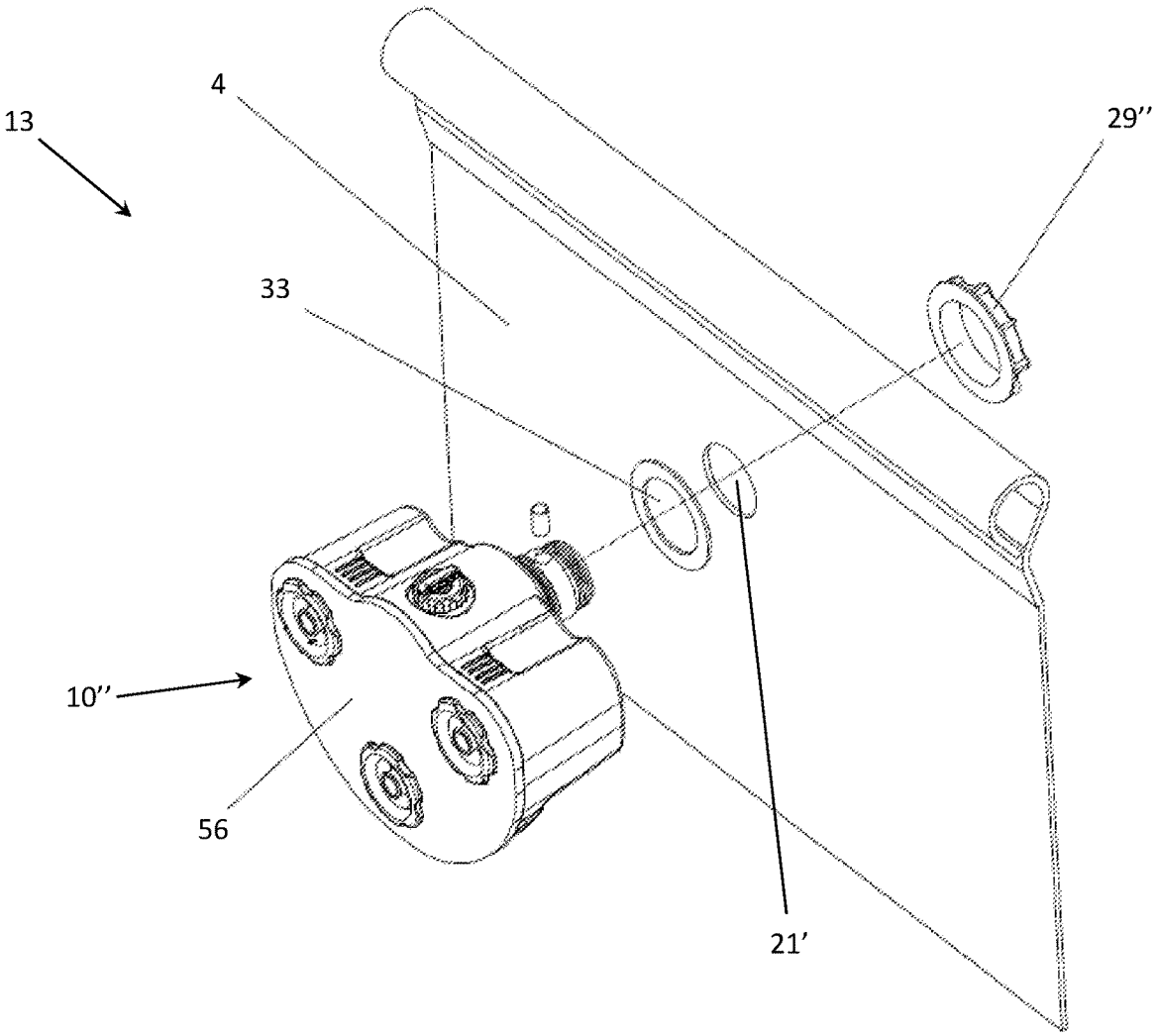
FIG. 14 is an exploded perspective view of the water spraying device of FIG. 13 and a wall of a water cavity.
Figure 15:
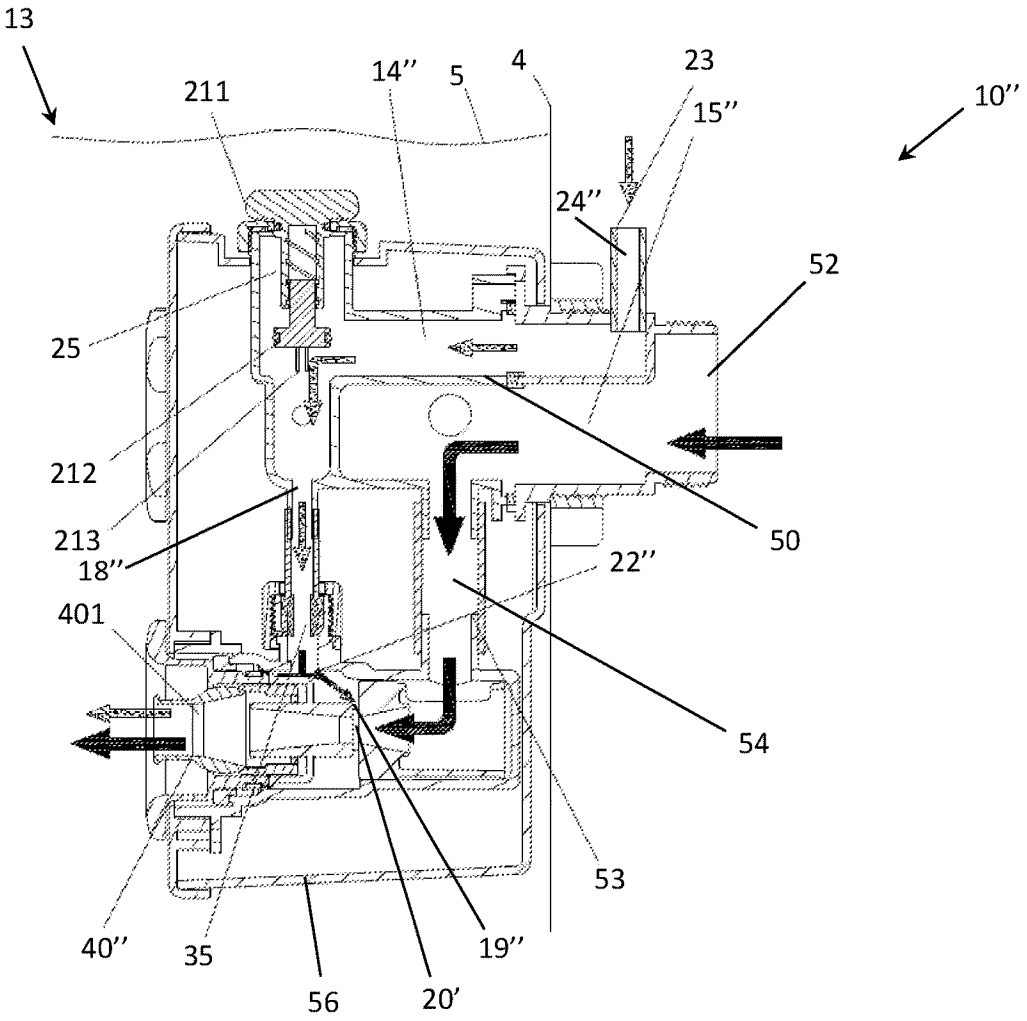
FIG. 15 is a cross-sectional view of the water spraying device of FIG. 13 including a check valve in an open position.

Referring now to FIGS. 13-15, water spraying device 10" is disclosed which may have various features in common with the above-described water spraying devices 10, 10', except as described below. In various embodiments, water spraying device 10" may include a plurality of aeration nozzles 11" and a main pipe 48. In an exemplary embodiment, water spraying device 10" includes three aeration nozzles 11". Wall 4 of water cavity is disposed with a single through hole 21, wherein an upstream end of main pipe 48 runs through hole 21. Coupler 29" may couple to the upstream end of main pipe 48 that extends through hole 21 in wall 4 such that water spraying device 10" is coupled to wall 4, wherein a washer 33 may help seal the connection between wall 4 and main pipe 48. In an exemplary embodiment, coupler 29" is a nut threaded onto threads about the upstream end of main pipe 48. Furthermore, the upstream end of main pipe 48 may include additional threads such that a water pipe (not shown, but similar to the above-described water pipes 12, 12') may be coupled to main pipe 48 of water spraying device 10".

Each aeration nozzle 11" of water spraying device 10" generally includes a nozzle body 17' having at least a portion of an air way 14", including air inlet 35 of air way 14", at least a portion of a water way 15", including water inlet 53 of water way 15", a water-air mixing portion 20' that connects air way 14" and water way 15" in the inner portion of aeration nozzle 11", and a check valve 22" arranged along suction hole 18" for controlling the direction of air flow through air way 14". Furthermore, in various embodiments, each nozzle 11" may further include a spraying portion 40".

Still referring to FIGS. 13 and 15, main pipe 48 generally includes an air inlet valve 25, an air inlet pipe 23, a portion of air way 14" and a portion of water way 15", wherein air way 14" is separated from water way 14" by a wall 50. Air inlet 24" of air way 14" may be an upstream end of air inlet pipe 23. Air inlet 24" and air inlet pipe 23 are disposed at the outer surface of wall 4, and are positioned lower than the water level 5 of water cavity 13. Additionally, a water pipe of water spraying device 10" may be coupled to a water inlet 52 of water way 15" of main pipe 48. Air way 14" and water way 15" within main pipe 48 may be separated into separate aeration nozzles 11" through suction holes 18" and water outlets 54, respectively.

Figure 16:
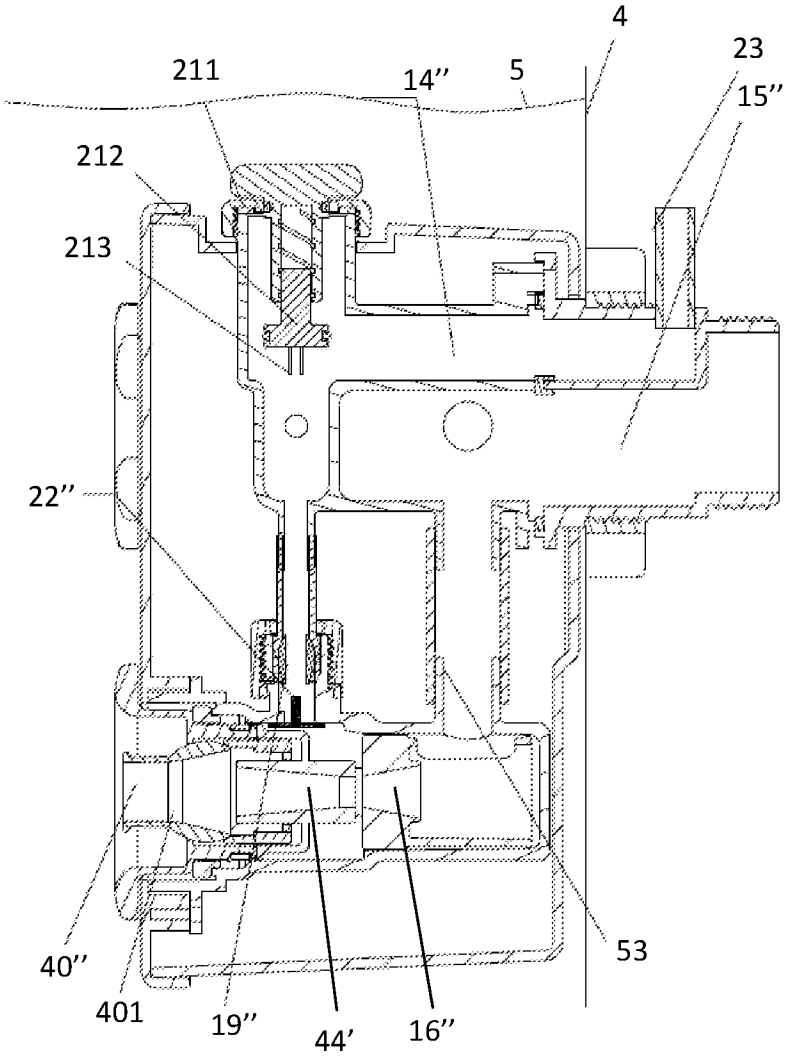
FIG. 16 is a cross-sectional view of the water spraying device of FIG. 15 including the check valve in a closed position.
Figure 17A:
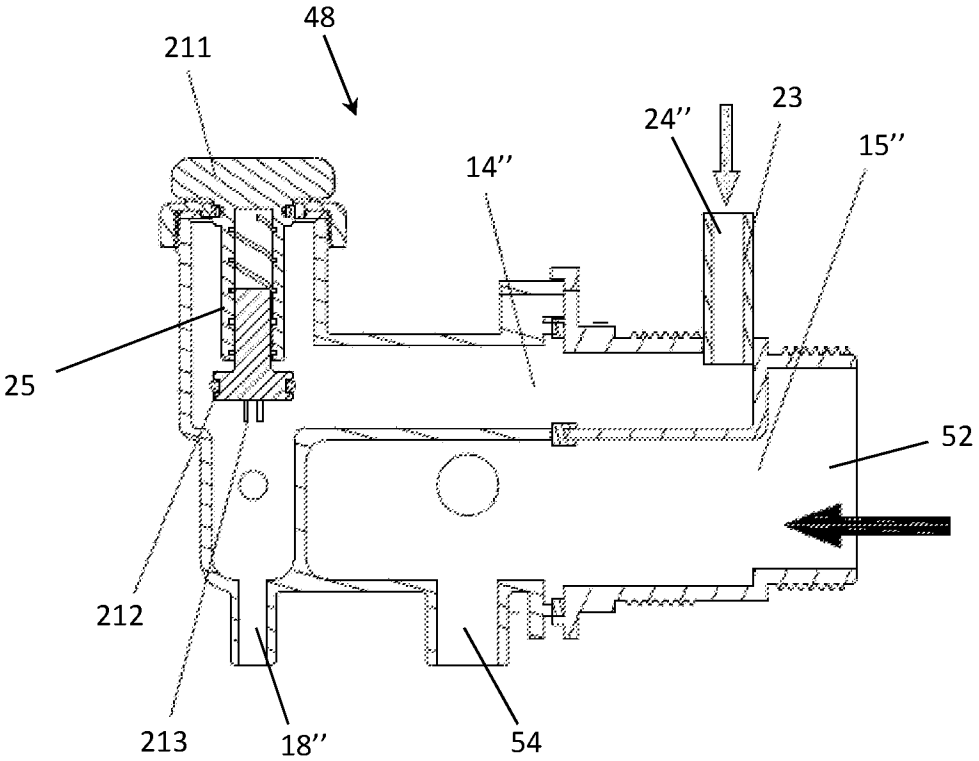
FIG. 17A is a cross-sectional view of a main pipe of the water spraying device of FIG. 10 including an air inlet valve in an open position.
Figure 17B:
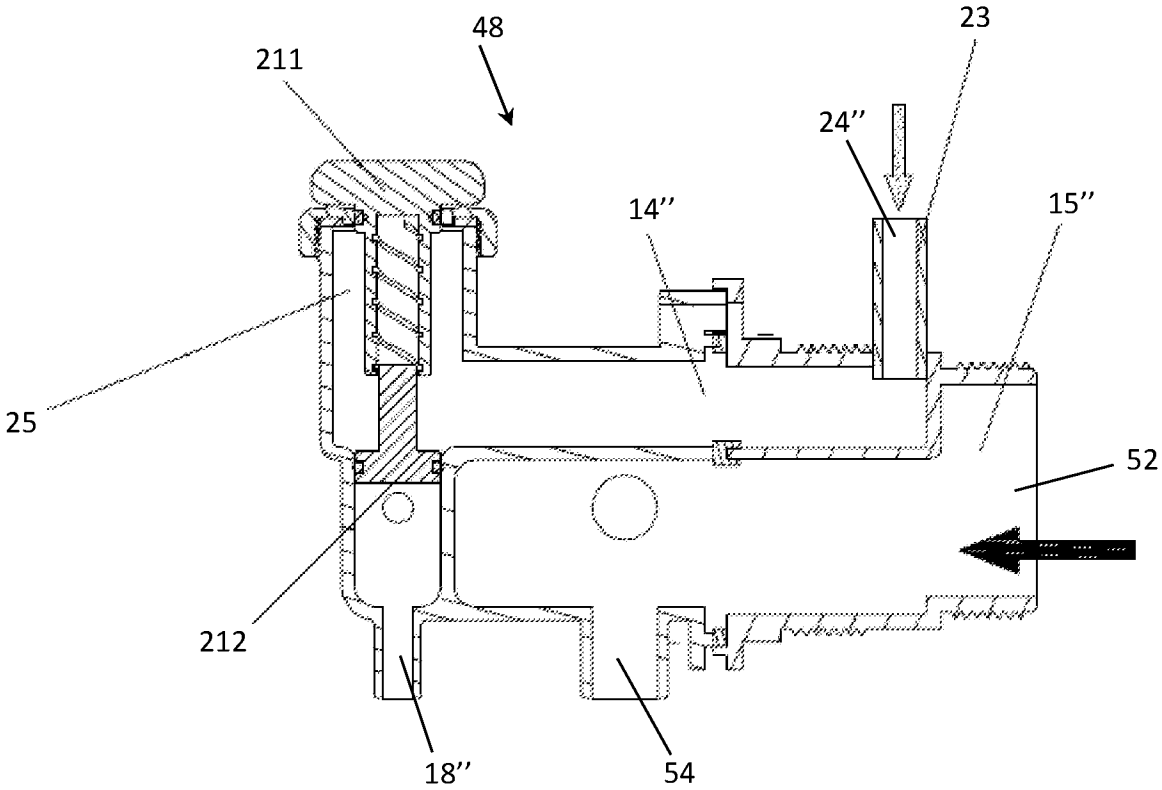
FIG. 17B is a cross-sectional view of the main pipe of FIG. 17A wherein the air inlet valve is in a closed position.

Referring to FIGS. 15-17, because air inlet pipe 23 of air way 14" is lower than the water level 5, air way 14" is disposed with air inlet valve 25 to open and close air way 14". Air inlet valve 25 generally comprises a rotation handle 211, a sealing slide block 212 and a slide guide 213. When rotating rotation handle 211, sealing slide block 212 slides along slide guide 213, so as to close air way 14" (FIG. 17B) or open air way 14" (FIG. 17A).

When the water spraying device 10" is in normal working condition, water flows into water inlet 52 of water way 15" of main pipe 48, and then flows through water outlet 54 of main pipe 48 into a water inlet 53 of each aeration nozzle 11" of water spraying device 10". The water then flows through conical hole 16", wherein the speed of the water increases as the water flows therethrough. When water passes air outlet 19", under the work of siphon caused by the increase in water speed, air is pulled into air inlet pipe 23 of main pipe 48. Air then flows through air way 14" and suction hole 18" before entering air inlet 35 of each aeration nozzle 11" and being incorporated into the water passing air outlet 19" in water-air mixing portion 20'. The water infused with air then flows through outlet hole 44' to spray out of spraying portion 40" and into water cavity 13 after mixing. In general, water spraying device 10" applies the siphon principle such that it automatically absorbs air during the water spraying. Because of this, no air pump is needed to mix the water and air, and water spraying device 10" can still spray massage water out or cycle and filter the water.

When the water flow to spraying device 10" is turned off, water does not enter the water inlet 52 and air is not pulled into the air inlet 23. Rotating the rotation handle 211 can close the air way 14", thus preventing water from water cavity 13 from flowing back to the air way 14".

In various embodiments, water spraying device 10" may further include a spraying valve 401 disposed within spraying portion 40". Rotating spraying valve 401 can adjust the outlet velocity of spraying portion 40", such as by changing the area of water way 15".

With reference to FIGS. 13 and 14, in various embodiments, water spraying device 10" may further including a housing 56 surrounding at least portions of aeration nozzle (s) 11" and main pipe 48, wherein housing 56 includes a panel 58 and a cover plate 60. In various embodiments, panel 58 may be a deep housing wherein aeration nozzle(s) 11" may be placed almost entirely within panel 58.

Furthermore, in various embodiments, main pipe 48 may be omitted such that the water way 15" and the air way 14" of each aeration nozzle 11" are used for air inlet 24' and water inlet 52'. In addition, water spraying device 10" may further comprise an air pump (not shown) connected to air inlet pipe 23. The air pump may be used to increase the air outlet volume of water spraying device 10".

Figure 18:
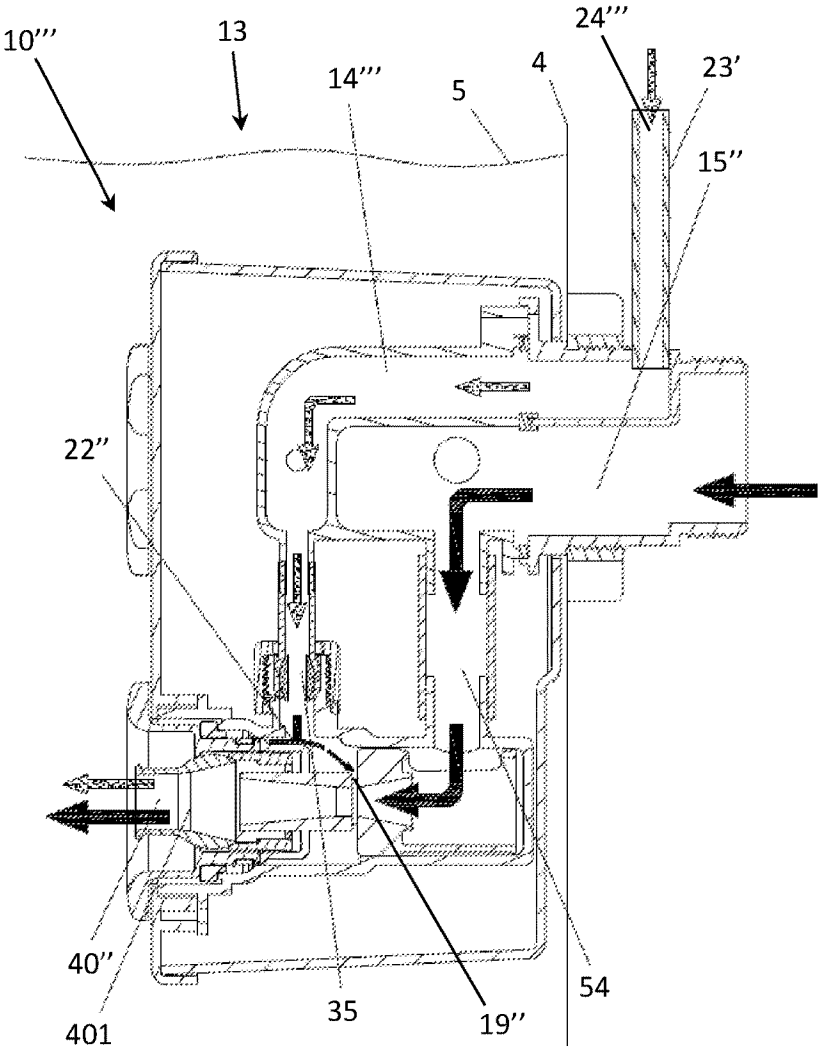
FIG. 18 is a cross-sectional view of another embodiment of a water spraying device of the present disclosure including a check valve in an open position.
Figure 19:
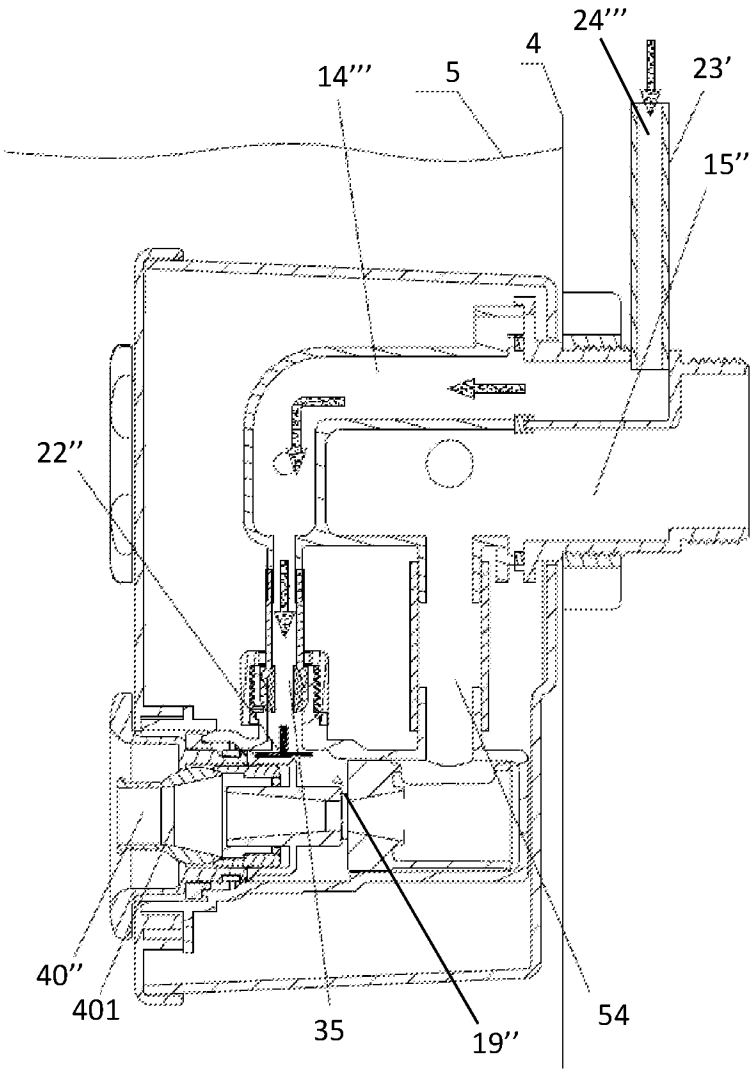
FIG. 19 is a cross-sectional view of the water spraying device of FIG. 18 wherein the check valve is in a closed position.
Figure 20:
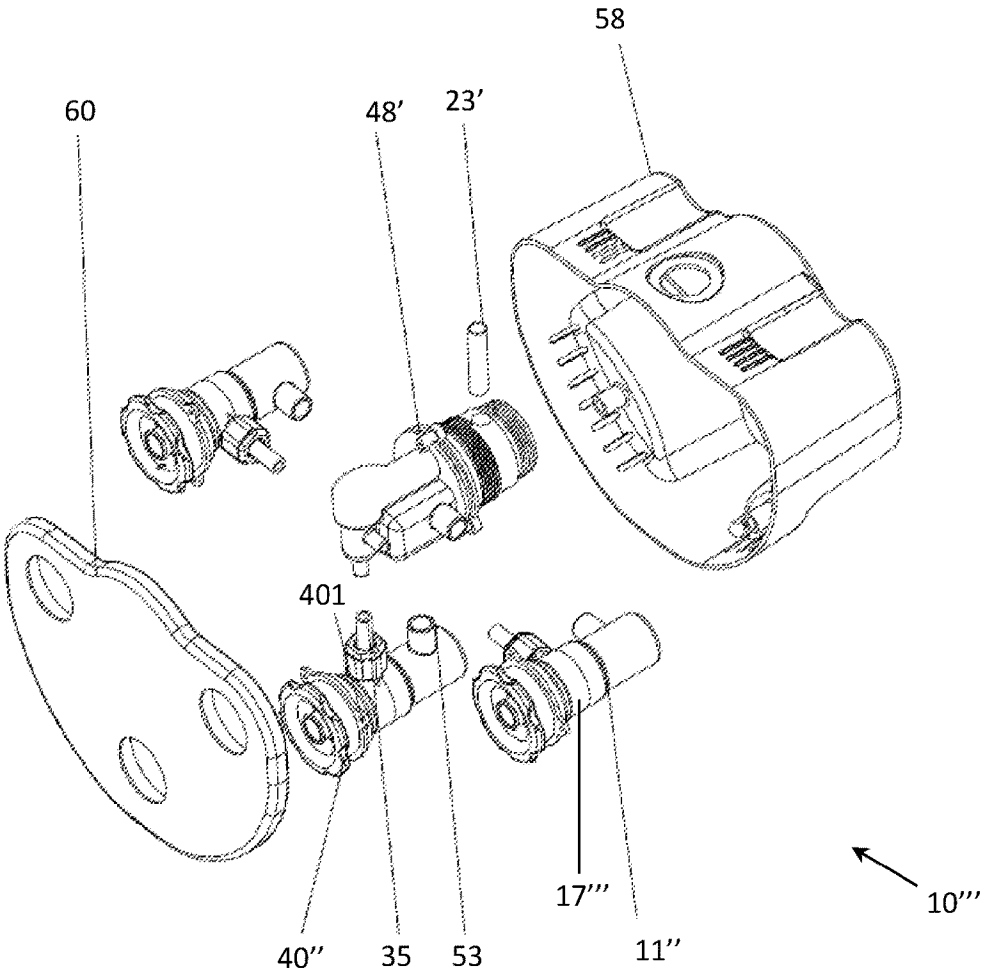
FIG. 20 is an exploded view of the water spraying device of FIG. 18.

Referring now to FIGS. 18-20, water spraying device 10'" is disclosed which may have various features in common with the above-described water spraying devices 10, 10', 10", except as described below. Water spraying device 10'" may include a main pipe 48' having an air inlet 24" of air inlet pipe 23' which may be higher than the water level 5 of water cavity 13, so that water may not flow back to air way 14". When air inlet 24" is higher than water level 5, it may be unnecessary to include air inlet valve 25 along air way 14'".

Any of the above-described water spraying devices 10, 10', 10", 10'" may be coupled to the pool in a variety of different ways, as discussed further below.

Figure 21:
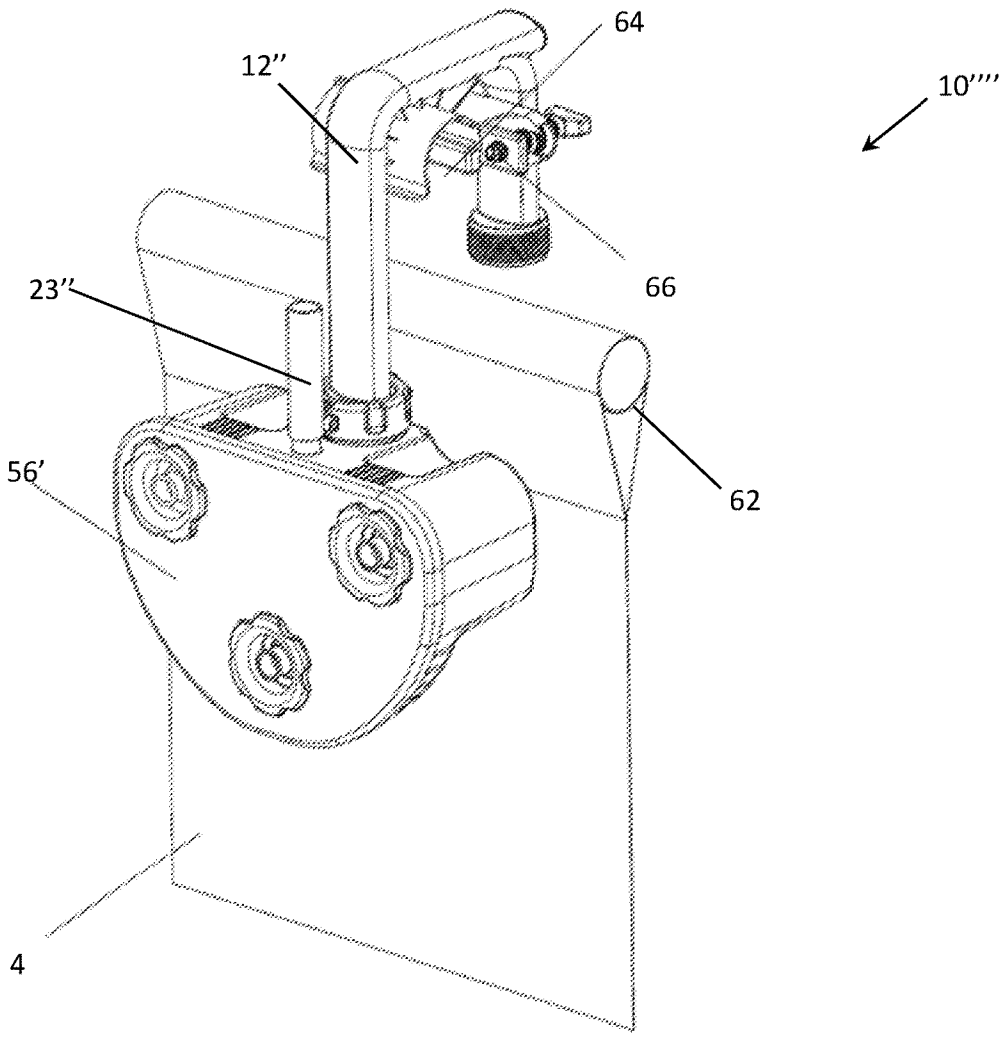
FIG. 21 is a perspective view of another embodiment of a water spraying device of the present disclosure.
Figure 22:
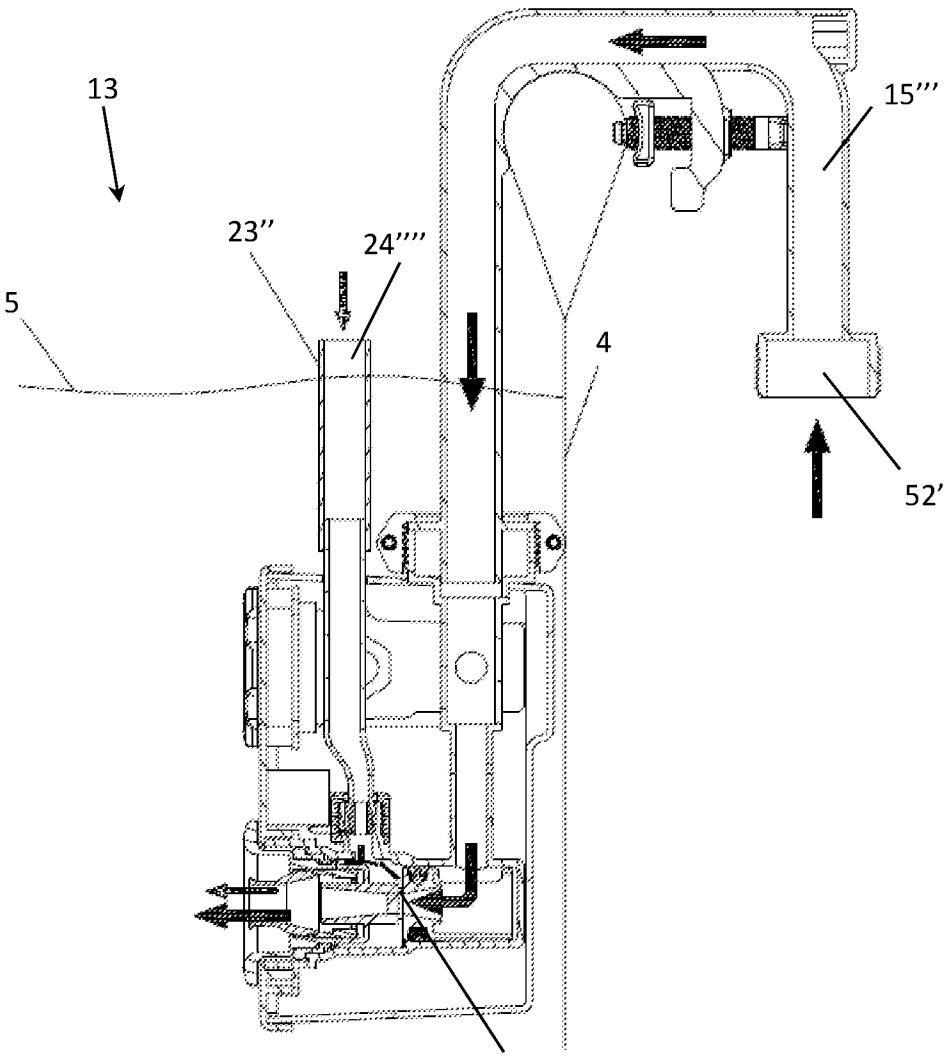
FIG. 22 is a cross-sectional view of the water spraying device of FIG. 21.

Referring to FIGS. 21 and 22, water spraying device 10"" may be coupled to a pipe rack 62 positioned along an upper surface of wall 4 of water cavity 13. In various embodiments, water way 15'" may extend through an upward facing surface of housing 56' of water spraying device 10"" and up and over wall 4 such that water inlet 52' is positioned outside of water cavity 13. Furthermore, air inlet pipe 23" may extend upward through housing 56' such that air inlet pipe 23" extends within the interior portion of water cavity 13, wherein air inlet 24'" is above water level 5 within water cavity 13. In one embodiment, air inlet pipe 23" and water pipe 12" are both upwardly extending through housing 56' within the interior portion of water cavity 13. Furthermore, in various embodiments, water spraying device 10"" may be coupled to pipe rack 62 along water pipe 12". In an exemplary embodiment, water pipe 12" includes a groove or cuff 64 that may extend about pipe rack 62. Cuff 64 may include a coupling device 66 for tightening water pipe 12" to pipe rack 62. In an exemplary embodiment, coupling device 66 is a lock block. In an exemplary embodiment, cuff 64 is sleeved on the outer surface of pipe rack 62. By rotating a nut of coupling device 66, coupling device 66 is abutted against pipe rack 62 to accomplish a locked or fixed coupling between pipe rack 62 and cuff 64.

Figure 23:
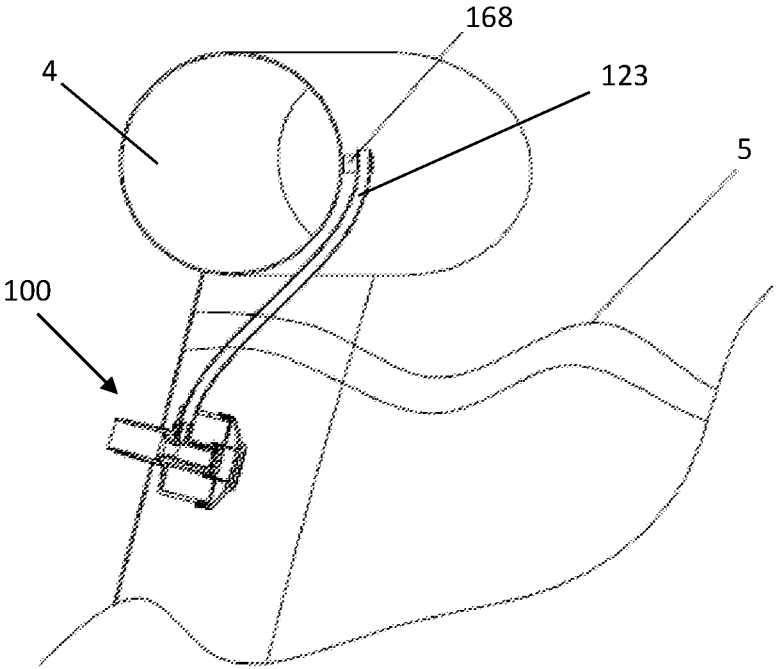
FIG. 23 is a cross-sectional view of an embodiment of an air inlet pipe of a water spraying device of the present disclosure coupled to a wall of a water cavity, wherein an air pipe of the water spraying device is disposed at an inner surface of the wall of the water cavity.
Figure 24:
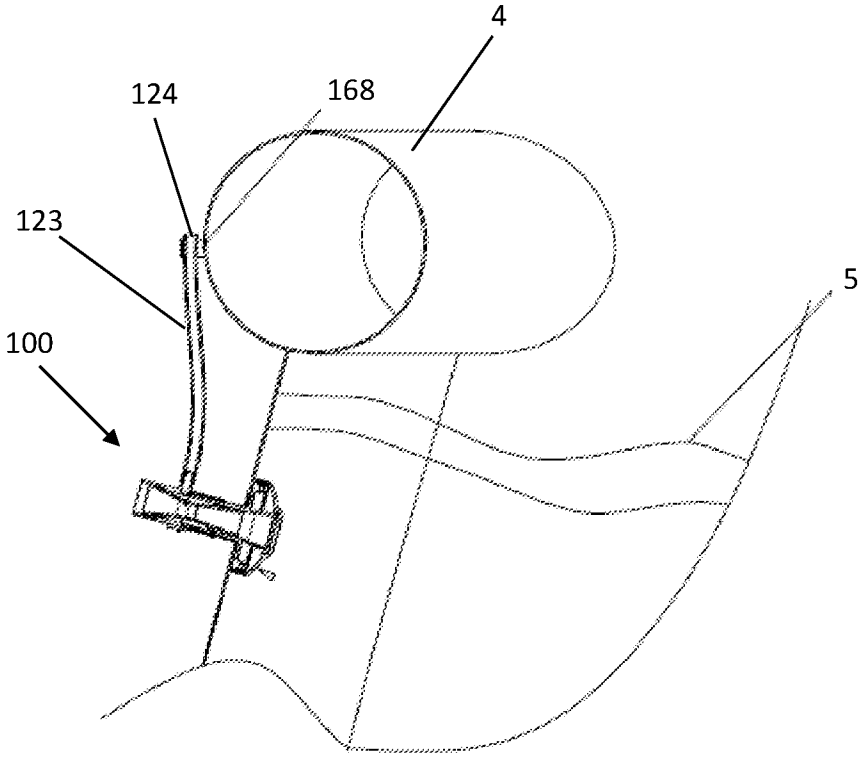
FIG. 24 is a cross-sectional view of an embodiment of an air inlet pipe of a water spraying device of the present disclosure coupled to a wall of a water cavity, wherein the air pipe is disposed at an outer surface of the wall of the water cavity.

Referring to FIGS. 23 and 24, water cavity 13 may include a water spraying device 100 having a coupling device 168 for keeping air inlet 124 of air inlet pipe 123 above the water level 5. Water spraying device 100, air inlet 124 and air inlet pipe 123 may be any of those previously described above. In various embodiments, coupling device 168 may couple air inlet pipe 123 to wall 4 of water cavity 13 at a position higher than the water level 5. Coupling device 168 may be adhesive tape, a nut and bolt, a screw or other similar coupling devices. In addition, in various embodiments, air inlet pipe 123 may be disposed at an inner side (FIG. 23) or an outer side (FIG. 24) of wall 4 of water cavity 13.

Figure 25:
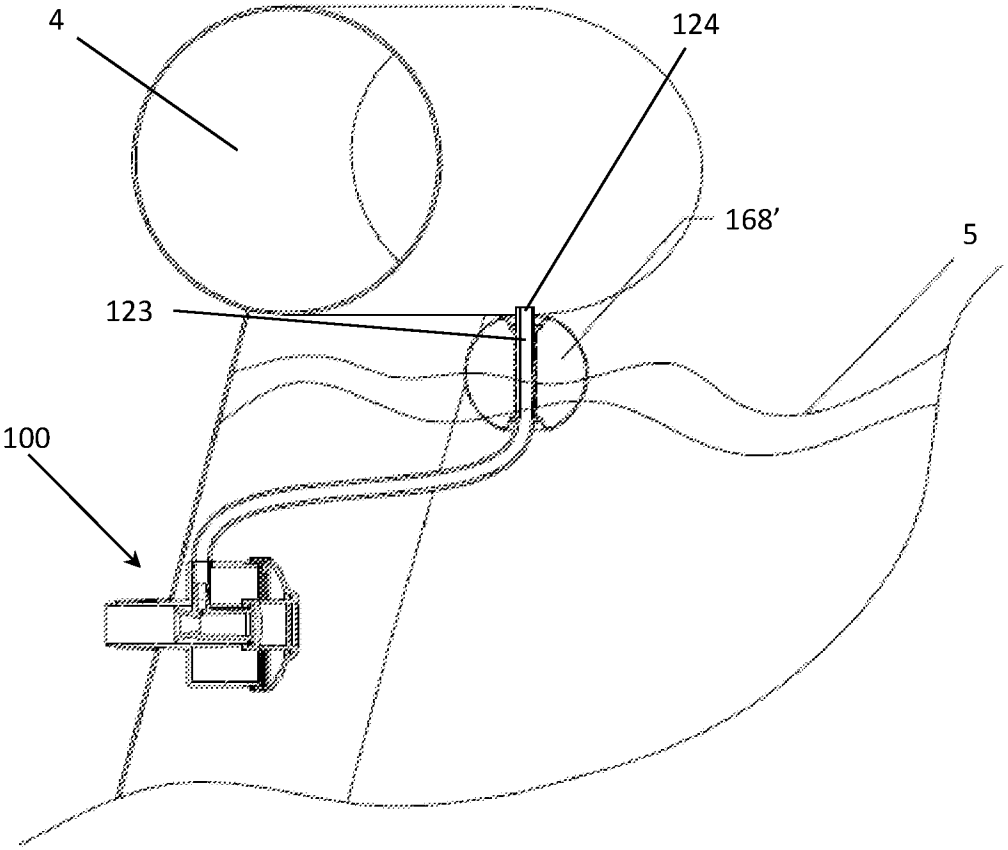
FIG. 25 is a cross-sectional view of another embodiment of an air inlet pipe of a water spraying device of the present disclosure, wherein the air pipe is disposed in a float at an inner surface of a wall of a water cavity.

Referring now to FIG. 25, coupling device 168' may be a floating object (e.g., ball), wherein the floating ball allows air inlet 124 of air inlet pipe 123 to remain above the water level 5 so long as the floating ball is above water level 5.

Figure 26:
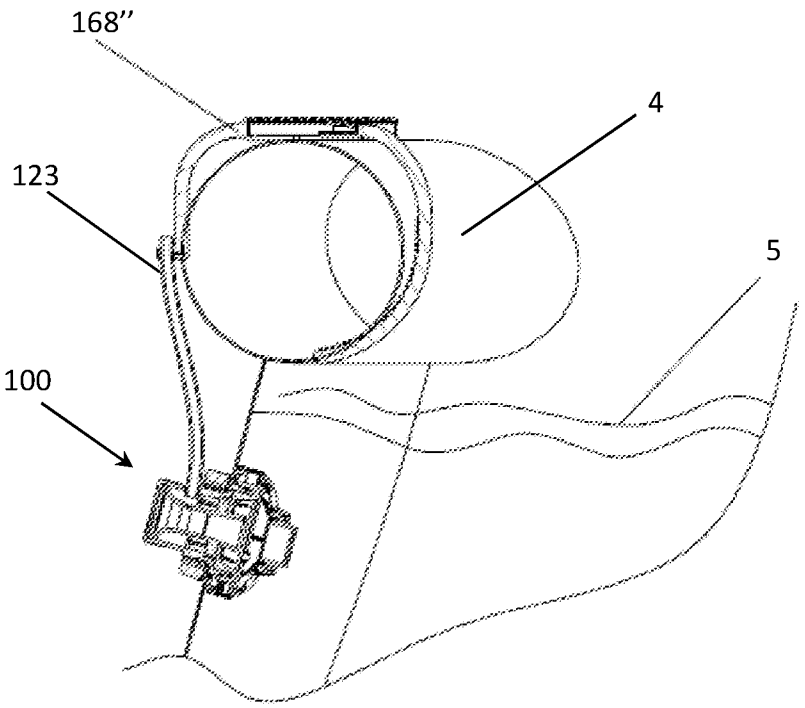
FIG. 26 is a cross-sectional view of another embodiment of an air inlet pipe of a water spraying device of the present disclosure, wherein the air inlet pipe is coupled about an upper surface of a wall of a water cavity from an exterior portion of the water cavity.
Figure 27:
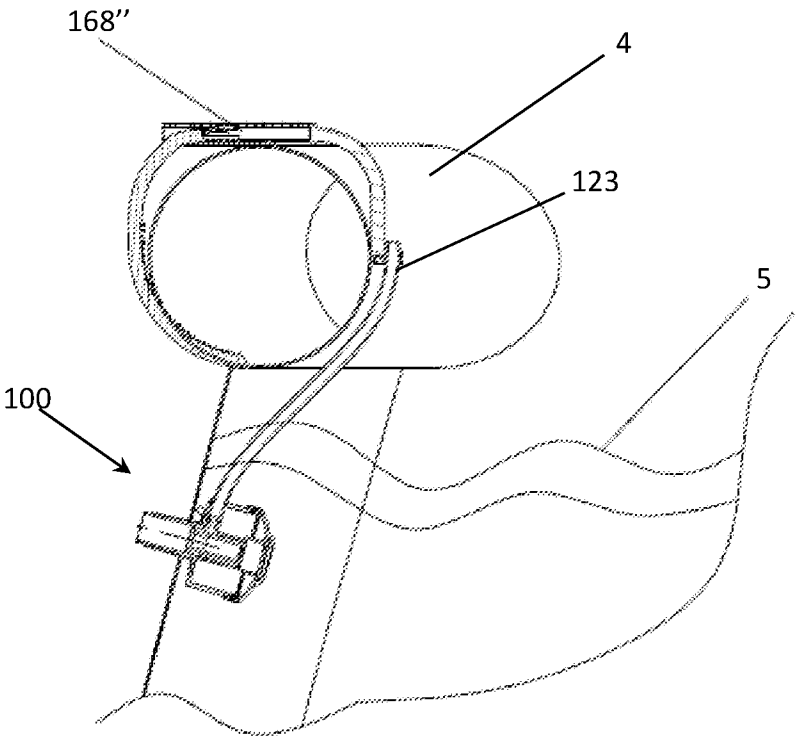
FIG. 27 is a cross-sectional view of another embodiment of an air inlet pipe of a water spraying device of the present disclosure, wherein the air pipe is coupled about an upper surface of the wall of the water cavity from an interior portion of the water cavity.

Referring to FIGS. 26 and 27, coupling device 168" may be a fixation rack, wherein the fixation rack is coupled to an upper surface of wall 4 of water cavity 13. In various embodiments, fixation rack 68" may include a lock groove to fix to air inlet pipe 123. Air inlet pipe 123 may be disposed at the inner side (FIG. 27) or the outer side (FIG. 26) of the water cavity 13.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An aeration nozzle for spraying water infused with air into an above-ground water cavity defined by a wall, the aeration nozzle comprising:

a base having an upstream end and a downstream end;

a nozzle body comprising:

a first internal conical portion, the first internal conical portion including an upstream end and a downstream end, wherein the downstream end is smaller than the upstream end;

a second internal conical portion, a smaller, upstream end of the second internal conical portion being congruent with the downstream end of the first internal conical portion;

a head coupled to a downstream end of the second internal conical portion, the head having a diameter that is greater than a diameter of the downstream end of the second internal conical portion, wherein the nozzle body is positionable within the base with the upstream end of the first internal conical portion positioned adjacent the upstream end of the base and the head extending downstream beyond the downstream end of the base;

a first extension including a first seal extending from around the upstream end of the first internal conical portion; and a second extension including a second seal extending from around the second internal conical portion, wherein both the first seal and the second seal abut the base; and a water way extending through the nozzle body and the first and second internal conical portions;

an air way extending through the nozzle body, wherein the air way intercepts the water way within the nozzle body downstream of the first internal conical portion and upstream of the second internal conical portion; and a check valve disposed along the air way, wherein the check valve permits air to be pulled through the air way and into the water way by way of a vacuum force caused by water flowing within the water way through the first internal conical portion and prevents water from entering the air way.

2. The aeration nozzle of claim 1 further comprising:

a spraying portion coupled to a downstream end of the base, wherein at least a portion of the base is located externally of the wall and the spraying portion is located internally of the wall and inside the water cavity.

3. The aeration nozzle of claim 1, wherein the air way includes an air inlet positioned vertically higher than at least a portion of the nozzle body.

4. The aeration nozzle of claim 3, wherein the air inlet is positioned above a filled water level within the water cavity.

5. The aeration nozzle of claim 3, wherein the air inlet is positioned below a filled water level within the water cavity.

6. The aeration nozzle of claim 3, wherein the air inlet is in direct communication with ambient air such that air is drawn into the air inlet of the air way without an air pump.

7. The aeration nozzle of claim 1, wherein an intersection between the air way and the water way is substantially perpendicular.

8. The aeration nozzle of claim 1, wherein the wall is supported by an upper rack, and the water way and the air way both extend through the wall at a location vertically beneath the upper rack.

9. The aeration nozzle of claim 1, wherein a diameter of the downstream end of the base is larger than a diameter of the upstream end of the base.

10. The aeration nozzle of claim 1, wherein the check valve is threadingly coupled to the base.

11. The aeration nozzle of claim 1, wherein the base includes a connector portion and a head portion, the head portion being positionable inside an inner surface of the wall.

12. The aeration nozzle of claim 1, wherein the first extension and the second extension are both positionable outside of the wall.

13. The aeration nozzle of claim 1, wherein the base is coupled to a water pipe via a threaded coupler.

14. The aeration nozzle of claim 13, wherein the upstream end of the base, a downstream end of the water pipe and the upstream end of the first internal conical portion are configured to overlap with the threaded coupler.

15. The aeration nozzle of claim 1, wherein the second internal conical portion is positionable to extend through the wall.

16. The aeration nozzle of claim 1 further including a spraying portion, wherein the spraying portion is threadingly engaged with exterior threads on the base.

17. An above ground pool assembly comprising:

a wall having an inner side that defines an above ground water cavity and an outer side;

an upper rack supporting the wall;

an aeration nozzle including:

a base having an upstream end and a downstream end;

a nozzle body comprising:

a first conical portion, the first conical portion including an upstream end and a downstream end, wherein the downstream end is smaller than the upstream end; and a second internal conical portion, a smaller, upstream end of the second internal conical portion being congruent with the downstream end of the first conical portion;

wherein the upstream end of the first internal conical portion and the downstream end of the second internal conical portion are disposed on either side of the wall;

a spraying portion being threadingly engaged with exterior threads on the base;

a water way extending through the first conical portion of the nozzle body; and an air way extending through the nozzle body and intercepting the water way within the nozzle body downstream of the first conical portion and upstream of the second internal conical portion, the water way and the air way both extending through the wall at a location vertically beneath the upper rack.

18. The pool assembly of claim 17, wherein the aeration nozzle further includes a check valve disposed along the air way to permit air to be pulled through the air way and into the water way by way of a vacuum force caused by water flowing within the water way and to prevent water from entering the air way.

19. The pool assembly of claim 17, wherein the spraying portion is separable from the nozzle body and positioned within the water cavity.

20. The pool assembly of claim 17, wherein the air way includes an air inlet positioned within the water cavity and above a filled level of water within the water cavity.

21. The pool assembly of claim 17, wherein the air way includes an air inlet positioned outside of the water cavity.

22. An above ground pool assembly comprising:

a wall having an inner side that defines an above ground water cavity and an outer side;

an aeration nozzle including;

a base having an upstream end, a downstream end, and a head portion adjacent the downstream end, the head portion being positionable inside an inner surface of the wall;

a nozzle body comprising:

a first internal conical portion, the first internal conical portion including an upstream end and a downstream end, wherein the downstream end is smaller than the upstream end; and a second internal conical portion, a smaller, upstream end of the second internal conical portion being congruent with the downstream end of the first conical portion;

wherein the upstream end of the first internal conical portion and the downstream end of the second internal conical portion are disposed on either side of the wall;

a water way extending through the nozzle body; and an air way extending through the nozzle body and intersecting the water way downstream of the first internal conical portion and upstream of the second internal conical portion, the air way including an air inlet in direct communication with ambient air, wherein air is drawn into the air inlet of the air way, without an air pump, by a vacuum force caused by water flowing within the water way.

23. The pool assembly of claim 22, wherein the air inlet is positioned outside of the water cavity and below a filled level of water within the water cavity.

24. The pool assembly of claim 22, wherein the aeration nozzle further includes a check valve positioned downstream of the air inlet.

25. The pool assembly of claim 22, wherein the air inlet is positioned above a filled level of water within the water cavity and at least one of internal or external of the water cavity.

* * * * *